US008496131B2

(12) United States Patent
Forrest et al.

(10) Patent No.: US 8,496,131 B2
(45) Date of Patent: Jul. 30, 2013

(54) CAP FOR A LUG-TYPE CLOSURE

(75) Inventors: Randall G. Forrest, Park Ridge, IL (US); Timothy L. Turner, Port Charlotte, FL (US); Michael R. Gogola, Itasca, IL (US); V. Steven Jackson, Lombard, IL (US); Ronald D. Parrella, Arlington Heights, IL (US)

(73) Assignee: Rexam Beverage Can Company, Chicago, IL (US)

( * ) Notice: Subject to any disclaimer, the term of this patent is extended or adjusted under 35 U.S.C. 154(b) by 18 days.

(21) Appl. No.: 13/125,205

(22) PCT Filed: Oct. 20, 2009

(86) PCT No.: PCT/US2009/061323
§ 371 (c)(1),
(2), (4) Date: Aug. 5, 2011

(87) PCT Pub. No.: WO2010/048180
PCT Pub. Date: Apr. 29, 2010

(65) Prior Publication Data

US 2011/0278255 A1 Nov. 17, 2011

Related U.S. Application Data

(63) Continuation-in-part of application No. 12/255,291, filed on Oct. 21, 2008.

(51) Int. Cl.
*B65D 41/00* (2006.01)

(52) U.S. Cl.
USPC ..... 220/310.1; 215/317

(58) Field of Classification Search
USPC ..... 220/310.1, 309.1, 213, 806, 796, 220/378, 795, 780, 794, FOR. 102, FOR. 100, 220/FOR. 104, FOR. 103, FOR. 111, FOR. 105, 220/200; 215/317, 324, 327, 316, 45, 43, 215/200, 321; 53/487, 485, 484, 476
IPC ..... B65D 41/16,41/02, 41/00
See application file for complete search history.

(56) References Cited

U.S. PATENT DOCUMENTS

| | | | |
|---|---|---|---|
| 1,035,634 | A | 8/1912 | Platt |
| 1,703,573 | A | 2/1929 | Carvalho |

(Continued)

FOREIGN PATENT DOCUMENTS

| | | | |
|---|---|---|---|
| DE | 1432117 | A1 | 11/1968 |
| GB | 396245 | A | 8/1933 |
| NL | 8400752 | A | 10/1985 |

OTHER PUBLICATIONS

European Patent Office as International Searching Authority, International Search Report for PCT/US2009/061323 mailed Jan. 21, 2010.

*Primary Examiner* — Mickey Yu
*Assistant Examiner* — Robert J Hicks
(74) *Attorney, Agent, or Firm* — Ungaretti & Harris, LLP

(57) ABSTRACT

A cap 80 for sealing a container having a closure assembly with lug members on the container for sealing with corresponding lugs on the cap 80 has a top panel 84 and a circumferential side wall panel 82, has a top panel 84 and a circumferential side wall panel 82. The top panel 84 is positioned about a longitudinal axis 50 and extends radially outwardly therefrom. The circumferential side wall panel 82 is integral with an outer peripheral edge of the top panel 84 and has first, second, and third segments 90, 92, 94. The first segment 90 extends downwardly. The second segment 92 extends radially outwardly at a first angle to the first segment 90. The third segment 94 extends downwardly from the second segment 94 at a second angle to the second segment 92.

21 Claims, 19 Drawing Sheets

U.S. PATENT DOCUMENTS

| | | | |
|---|---|---|---|
| 1,858,826 | A | 5/1932 | Holland |
| 2,007,257 | A | 7/1935 | Scofield |
| 2,337,616 | A | 12/1943 | McManus et al. |
| 2,445,647 | A | 7/1948 | Thomas |
| 3,071,275 | A | 1/1963 | Foss et al. |
| 3,133,656 | A | 5/1964 | Foster |
| 3,219,004 | A | 11/1965 | Wilton |
| 3,270,904 | A | 9/1966 | Foster et al. |
| 3,460,703 | A | 8/1969 | Leftault, Jr. |
| 3,704,677 | A | 12/1972 | Moller |
| 3,844,443 | A | 10/1974 | Cudzik |
| 3,868,038 | A | 2/1975 | Hadley |
| 3,967,746 | A | 7/1976 | Botkin |
| 4,341,324 | A | 7/1982 | Ramirez |
| 4,452,365 | A | 6/1984 | Ascasibar-Verdejo |
| 5,322,177 | A | 6/1994 | Coggings |
| 6,015,062 | A | 1/2000 | Bachmann et al. |
| 6,082,944 | A | 7/2000 | Bachmann et al. |
| 6,959,830 | B1 | 11/2005 | Kanou et al. |
| 7,171,840 | B2 | 2/2007 | Kanou et al. |
| 2005/0051554 | A1 | 3/2005 | Cook et al. |
| 2005/0115294 | A1 | 6/2005 | Kanou et al. |
| 2005/0138984 | A1 | 6/2005 | Cook et al. |
| 2006/0011633 | A1 | 1/2006 | Cook et al. |
| 2006/0016821 | A1 | 1/2006 | Liu |
| 2006/0113273 | A1 | 6/2006 | Kristensen |
| 2007/0062952 | A1 | 3/2007 | Kobayashi et al. |

CAP FOR A LUG-TYPE CLOSURE

CROSS-REFERENCE TO RELATED APPLICATIONS

This application is a United States application under 35 U.S.C. Section 371 of International Patent Application No. PCT/US2009/061323 filed on Oct. 20, 2009, which was a continuation-in-part of co-pending U.S. application Ser. No. 12/255,291 filed on Oct. 21, 2008, both of which are hereby incorporated by reference as if fully set forth herein.

TECHNICAL FIELD

The invention relates to beverage containers having resealable closures. More particularly, the present invention relates to closure caps for a seamable can end member having a lug-type closure assembly.

BACKGROUND OF THE INVENTION

Screw-on cap closures are known in the metal beverage container art. An open end of the container may be opened and resealed using the screw-on closure cap. A number of references teach such screw-on closure caps with many different features achieving differing levels of success.

One method involves production of a can body having a necked-in upper portion terminating at a threaded open end. These containers generally resemble screw top bottles. The threads are typically mechanically formed using the excess metal at the open end of the can body. Formation of the threads, however, is a difficult manufacturing process.

Recently, lug-type resealable closure systems have been introduced into the beverage market. Such closures are described in U.S. Pat. No. 6,082,944, issued to Bachman et al. These closure systems include a set of elongated lugs located about the container at an upper neck portion. These lugs cooperate with a second set of inwardly extending lug members formed in a curled rim of a cap member. When the cap member is attached to the upper neck portion, the cooperating lug members draw the cap against a curled seal rim of the container. These closure systems overcome some of the drawbacks of the threaded closures because the relatively expensive operation of threading the wall of the container body is avoided, and these types of closure systems enable the use of a container which has a very short skirt and therefore requires less material than the relatively long-skirted caps usually employed as a screw closure.

However, these types of closures often will not seal the open end of the container particularly well. Several cap variations have been introduced with mixed results. To date, no lug-type cap closure has performed well enough to meet a wide variety of end user requirements. Therefore, a lug-type closure system that can be reliably manufactured while overcoming the problems associated with fully threaded closures while providing a resealable closure cap is needed.

The present invention is provided to solve the problems discussed above and other problems, and to provide advantages and aspects not provided by prior closure caps of this type. A full discussion of the features and advantages of the present invention is deferred to the following detailed description, which proceeds with reference to the accompanying drawings.

SUMMARY OF THE INVENTION

One aspect of the present invention is directed to a cap for sealing a container having a lug-type closure assembly. The cap comprises a top panel positioned about a longitudinal axis and extends radially outwardly therefrom. A circumferential side wall panel is integral with an outer peripheral edge of the top panel and comprises a first segment extending downwardly, a second segment extending radially outwardly at a first angle to the first segment, and a third segment extending downwardly from the second segment at a second angle to the second segment. The cap may further comprise a sealing material located within the cap on an inner side of the top panel. The sealing material may terminate at an intersection between the top panel and the circumferential side wall.

The circumferential side wall of this aspect of the invention may be threadless. The circumferential side wall may further comprise a mating lug for cooperative engagement with a sealing lug located on a neck. The circumferential side may have a plurality of mating lugs for cooperative engagement with a plurality of sealing lugs located on a neck of a can end. At least a portion of the circumferential side wall may terminate in a radially outwardly formed curl which forms the mating lugs. Accordingly, a portion of the radially outwardly formed curl may be located radially inwardly of a lowermost end of the third segment joined to the curl.

The first segment of the circumferential side wall of this aspect of the invention may extend downwardly substantially parallel to the longitudinal axis.

The second segment of the circumferential side wall of this aspect of the invention may further extend downwardly relative to the first segment wherein the first angle as measured from an axis parallel to the longitudinal axis is less than 90 degrees and greater than 0 degrees. The angle may be less than or equal to 60 degrees and greater than or equal to 20 degrees. A length of the second segment may be greater than a length of the first segment.

The third segment of the circumferential side wall may have an upper portion joined to the second segment which is substantially parallel to the longitudinal axis.

Further to this aspect of the invention, the first segment may be separated from the second segment by a concave bend having a center of curvature located radially outwardly of the concave bend. The second segment may be separated from the third segment by a convex bend having a center of curvature located radially inwardly of the convex bend.

The top panel of this aspect of the invention may include a recessed countersink located radially inwardly of the outer peripheral edge of the top panel. The countersink may be annular and may further have a U-shaped cross-section. A portion of the top panel located radially inwardly from the annular recessed countersink may be located below a height of the outer peripheral edge of the top panel.

A portion of the top panel located radially inwardly from the outer peripheral edge of the top panel may be recessed below the outer peripheral edge. The top panel may include an annular top panel wall joining the recessed portion of the top panel with the outer peripheral edge of the top panel. The annular top panel wall extends upwardly and radially outwardly relative to the longitudinal axis. Alternatively, the annular top panel wall extends upwardly and substantially parallel to the longitudinal axis.

A second aspect of the present invention is directed to a cap for sealing a container having a lug-type closure assembly. The cap comprises a top panel and a circumferential side wall. The top panel is positioned about a longitudinal axis and extends radially outwardly therefrom. The top panel comprises an outer peripheral edge joined to a recessed central portion by an annular wall substantially parallel to the longitudinal axis. The circumferential side wall panel is integral with the outer peripheral edge of the top panel.

A third aspect of the present invention is directed to a cap having lug-type closure assembly comprising a top panel and a circumferential side wall. The top panel is positioned about a longitudinal axis and extends radially outwardly therefrom. The top panel comprises an outer peripheral edge joined to a remaining portion of the top panel by a countersink. The circumferential side wall panel is integral with the outer peripheral edge of the top panel. The countersink may be U-shaped.

A fourth aspect of the present invention is directed to A cap for sealing a container having a lug-type closure assembly. The cap comprises a top panel and a circumferential side wall. The top panel is positioned about a longitudinal axis and extends radially outwardly therefrom. The circumferential side wall is integral with an outer peripheral edge of the top panel and comprises comprising a segment extending downwardly and radially outwardly relative to the longitudinal axis. The segment is bounded at one end by a circumferential concave bend at an uppermost extent and bounded at an opposite end by a first circumferential convex bend at a lowermost extent. The segment comprises a second circumferential convex bend located between the concave bend and the first convex bend. The second convex bend has a radius of curvature greater than a radius of curvature of the concave bend and the radius of curvature of the first convex bend.

A fifth aspect of the present invention is directed to a cap for sealing a container having a lug-type closure assembly. The cap comprises a top panel and a circumferential side wall. The top panel is positioned about a longitudinal axis and extends radially outwardly therefrom. The circumferential side wall panel is integral with an outer peripheral edge of the top panel and comprises a first segment extending downwardly separated from a second segment by a concave bend wherein the circumferential side wall panel terminates at a curl and the first and second segments are located between an uppermost portion of the circumferential side wall and the curl.

A sixth aspect of the present invention is directed to a cap for sealing a container having a lug-type closure assembly. The cap comprises a top panel and a circumferential side wall. The top panel is positioned about a longitudinal axis and extends radially outwardly therefrom. The circumferential side wall panel is integral with an outer peripheral edge of the top panel and comprises a segment angling downwardly and outwardly relative to the longitudinal axis and located between a pair of outwardly convex bends, the segment having a further outwardly convex bend having a substantially greater radius of curvature than either of the pair of outwardly convex bends.

A seventh aspect of the present invention is directed to a beverage can. The beverage can comprises a circumferential side wall, a bottom wall, a top wall, and a cap. The circumferential container side wall is positioned about a longitudinal axis. The bottom wall is integral with the side wall. The top wall comprises an upwardly extending reduced diameter neck having a plurality of radially outwardly extending lugs. The neck terminates at a curl defining a dispensing aperture. The cap seals the dispensing aperture and comprises a top panel and a segment angling downwardly and outwardly relative to the longitudinal axis. The top panel is positioned about the longitudinal axis and extends radially outwardly therefrom. The angled portion is located between a pair of outwardly convex bends. The angled portion has a further outwardly convex bend having a substantially greater radius of curvature than either of the pair of outwardly convex bends.

An eighth aspect of the present invention is directed to a cap for sealing a container having a lug-type closure assembly. The cap comprises: a top panel positioned about a longitudinal axis and extending radially outwardly therefrom; and, a circumferential side wall panel integral with an outer peripheral edge of the top panel comprising a first part extending downwardly and radially outwardly at an angle less than 90 degrees and a second part extending downwardly and substantially vertically from the first part wherein a radially inwardly concave bead is formed in the first part. The concave bead may be located at a distance greater than 1.78 cm from the longitudinal axis. The concave bead may be located at a distance between 1.78 cm and 1.85 cm from the longitudinal axis. The concave bead may have a radius of curvature less than 0.091 cm. The concave bead may have a radius of curvature between 0.015 cm and 0.091 cm. The concave bead may be bounded on opposing ends by a pair of radially outwardly convex bends having radii of curvature less than 0.223 cm. The concave bead may have a bead depth as measured from a public side of a lowermost point of a peripheral edge of the top panel less than or equal to 0.127 cm. The concave bead may have a bead depth as measured from a public side of a lowermost point of a peripheral edge of the top panel less between 0.051 cm and 0.102 cm. The cap may further comprise a disk of a polymeric material in communication with a product side of the cap. The concave bead may be circumferential. The cap may comprise a plurality of concave beads about a circumference of the cap. The cap may further comprise a disk of a polymeric material having an outer peripheral edge in communication with a product side of the concave bead.

A ninth aspect of the present invention is directed to a beverage container. The beverage container comprises: a circumferential container side wall positioned about a longitudinal axis, a bottom wall integral with the side wall; a top wall comprising an upwardly extending reduced diameter neck having a plurality of radially outwardly extending lugs wherein the neck terminates at a curl defining a dispensing aperture, and the curl has a radially outer portion having a flattened surface area; and a cap. The cap comprises: a top panel positioned about a longitudinal axis and extending radially outwardly therefrom; and, a circumferential side wall panel integral with an outer peripheral edge of the top panel comprising a first part extending downwardly and radially outwardly and a second part extending downwardly from the first part. The flattened surface area may be circumferential. The flattened surface area may have a vertical length less than 0.061 cm. The flattened surface area may have a vertical length greater than 0.046 cm. The flattened surface area may have a vertical length between 0.046 cm and 0.061 cm. The flattened surface area may have a substantially vertical orientation.

A tenth aspect of the present invention is directed to a cap for sealing a container having a lug-type closure assembly. The cap comprises: a top panel positioned about a longitudinal axis and extending radially outwardly therefrom; and, a circumferential side wall panel integral with an outer peripheral edge of the top panel comprising a first part extending downwardly and radially outwardly at angle less than 90 degrees and a second part extending downwardly and substantially vertically from the first part wherein the cap further comprises a faceted transition between the first and second parts. The cap may further comprise a disk of a polymeric material having an outer peripheral edge in communication with a product side of the faceted transition. The faceted transition may be circumferential.

An eleventh aspect of the present invention is directed to a cap for sealing a container having a lug-type closure assembly. The cap comprises: a top panel positioned about a longitudinal axis and extending radially outwardly therefrom; and, a circumferential side wall panel integral with an outer peripheral edge of the top panel comprising a first part extending downwardly and radially outwardly at an angle less than 40 degrees and a second part extending downwardly and substantially vertically from the first part. The angle may be less than 35 degrees. The angle of the first part may be less than 30 degrees. The angle of the first part may be between 10 degrees and 25 degrees.

A twelfth aspect of the present invention is directed to a cap for sealing a container having a lug-type closure assembly. The cap comprises: a top panel positioned about a longitudinal axis and extending radially outwardly therefrom; and, a circumferential side wall panel integral with an outer peripheral edge of the top panel comprising a first part extending downwardly and radially outwardly and a second part extending downwardly and substantially vertically from the first part wherein the first part has a portion extending farther radially outwardly than an uppermost portion of the second part. The first part may have a curved cross-sectional shape. The cap may be mushroom-shaped.

A thirteenth aspect of the present invention is directed to a cap for sealing a container having a lug-type closure assembly. The cap comprises: a top panel positioned about a longitudinal axis and extending radially outwardly therefrom; and, a circumferential side wall panel integral with an outer peripheral edge of the top panel comprising a first part extending downwardly and radially outwardly and a second part extending downwardly and substantially vertically from the first part wherein the first part has a channel along a product side of the cap. The cap may further comprise a disk of a polymeric material having an outer peripheral edge in communication with the channel. The channel may be formed by a mushroom-shape in the cap. The channel may be formed by a circumferential step in the side wall.

A fourteenth aspect of the present invention is directed to a cap for sealing a container having a lug-type closure assembly. The cap comprises: a top panel positioned about a longitudinal axis and extending radially outwardly therefrom, the top panel having a top bead formed radially inwardly from an outer peripheral edge of the top panel and adjacent thereto wherein a depth of the peripheral edge of the top panel is preferably about 30% less than a depth of the top bead as measure from an imaginary horizontal plane defined by a portion of the top panel located radially inward and adjacent to the top bead; and, a circumferential side wall panel integral with an outer peripheral edge of the top panel comprising a first part extending downwardly and radially outwardly and a second part extending downwardly from the first part. The depth of the top bead may be less than 0.102 cm. The top bead may be circumferential. A differential height between the peripheral edge of the top panel and a lowermost point of the top bead may be less than 0.030 cm.

A fifteenth aspect of the present invention is directed to a beverage container. The beverage container comprises: a circumferential container side wall positioned about a longitudinal axis; a bottom wall integral with the side wall; a top wall comprising an upwardly extending reduced diameter neck having a plurality of radially outwardly extending lugs, the neck terminating at a curl defining a dispensing aperture; and a cap for sealing the dispensing aperture. The cap comprises: a top panel positioned about a longitudinal axis and extending radially outwardly therefrom, the top panel having a top bead formed radially inwardly from an outer peripheral edge of the top panel and adjacent thereto; a liner of a polymeric material wherein a clearance gap between the liner and the outermost peripheral edge of the top panel, located between the curl of the flange and the top panel, is eliminated by varying the depth of the top bead relative to the depth of the outer peripheral edge of the top panel; and, a circumferential side wall panel integral with an outer peripheral edge of the top panel comprising a first part extending downwardly and radially outwardly and a second part extending downwardly from the first part.

A sixteenth aspect of the present invention is directed to a beverage container. The beverage container comprises: a circumferential container side wall positioned about a longitudinal axis; a bottom wall integral with the side wall; a top wall comprising an upwardly extending reduced diameter neck having a plurality of radially outwardly extending lugs, the neck terminating at a curl defining a dispensing aperture, and a flexible hinge located on the top wall between the lugs and the curl; and, a cap for sealing the dispensing aperture. The cap comprises: a top panel positioned about a longitudinal axis and extending radially outwardly therefrom; and, a circumferential side wall panel integral with an outer peripheral edge of the top panel comprising a first part extending downwardly and radially outwardly and a second part extending downwardly from the first part. The flexible hinge may comprise a first narrow channel formed in the neck of the top wall. The first narrow channel may be circumferential. The flexible hinge may further comprise a second narrow channel formed in the neck of the top wall. The first and second narrow channels may be circumferential. The first narrow channel may be formed in the public side of the neck. The first narrow channel may be formed in the product side of the neck. The first narrow channel may be formed in the public side of the neck, and the second narrow channel is formed in the product side of the neck. The first narrow channel may be located radially inward of the second narrow channel. The first and second narrow channels may be circumferential.

A seventeenth aspect of the present invention is directed to a cap for sealing a container having a lug-type closure assembly. The cap comprises: a top panel positioned about a longitudinal axis and extending radially outwardly therefrom; a liner of a polymeric material positioned within the cap adjacent a product side of the top panel and having a plurality extensions radiating outwardly from a center portion; and, a circumferential side wall panel integral with an outer peripheral edge of the top panel comprising a first part extending downwardly and radially outwardly and a second part extending downwardly from the first part wherein the extensions on the liner extend downwardly along a portion of the first part. At least some of the liner extensions may terminate at a radially outermost point at a pointed corner. The liner may have a starburst-shape.

An eighteenth aspect of the present invention is directed to a cap for sealing a container having a lug-type closure assembly. The cap comprises: a top panel positioned about a longitudinal axis and extending radially outwardly therefrom; a liner of a polymeric material positioned within the cap adjacent a product side of the top panel and having a one or more relief grooves formed into a surface of the liner; and, a circumferential side wall panel integral with an outer peripheral edge of the top panel comprising a first part extending downwardly and radially outwardly and a second part extending downwardly from the first part wherein the extensions on the liner extend downwardly along a portion of the first part. The relief groove may be circumferential. The relief groove may be a score groove. A second relief grove may be formed on an opposing surface of the liner. Both relief grooves may be circumferential.

It would be readily understood by one of ordinary skill in the art that, to the extent not expressly summarized above, any of the aspects of the present invention could be provided alone or in any non-conflicting combination to arrive at a beverage container and/or a cap therefore.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
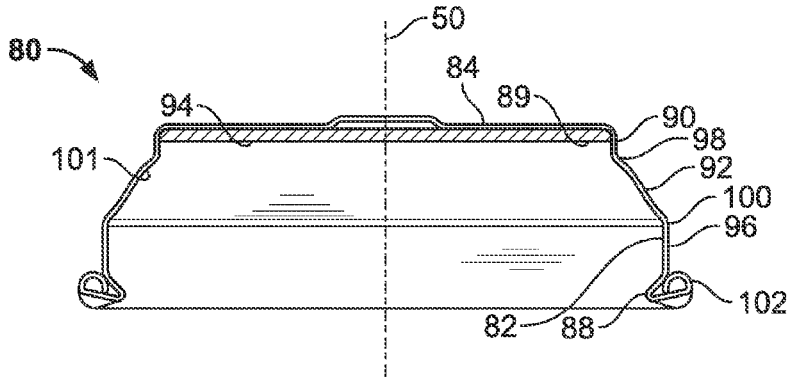
FIG. 1 is a cross-sectional view of a first embodiment cap closure of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1-8, can ends 10 for containers are illustrated. Each can end 10 has a seaming curl 12, a chuck wall 14, annular strengthening member 16, and a center or central panel wall 18. The can ends 10 may be seamed to close a can body 19 as illustrated in FIG. 9.

The seaming curl 12 defines the outer perimeter of the can end 10. The seaming curl 12 is provided for joining the can end 10 to a filled can body during a seaming process which is generally the standard means of joining can ends with can bodies used in the beverage industry today.

The chuck wall 14 extends downwardly and radially inwardly from the seaming curl 12. The chuck wall 14 may or may not include elements for strengthening the overall integrity of the can end.

The annular strengthening member 16 joins the chuck wall with the center panel 18. The annular strengthening member 16 may be a countersink as shown in the Figures, or the annular strengthening member 16 may be a fold or any other structure which serves to strengthen the can end without departing from the spirit of the invention disclosed herein.

The center panel 18 is centered about a vertical center or longitudinal axis 50. The center panel includes a dispensing aperture or opening 60, generally centered on the panel 18. The opening 60 is elevated above the peripheral edge 20 of the center panel 18 by an upwardly extending circumferential neck 68.

The neck 68, which terminates at the opening 60, has a circumferential shoulder 72. The shoulder 72 smoothly reduces the diameter of the neck 68 so that the diameter of the opening 60 is smaller than the diameter of a lowermost extent of the neck 68. This shoulder 72 is generally arcuate having a radius of curvature with a center of curvature located radially inwardly of the shoulder 72. The shoulder 72 terminates at a flange 76, preferably a curled portion of the neck 68 which defines the opening 60. This curl is formed such that it forms an annular tube, as differentiated from the seaming curl 12 which represents more of a hook-like structure.

Along a generally cylindrical skirt portion of the neck 68, positioned below the shoulder 72, is a lug-type closure assembly. This assembly includes a plurality of radially outwardly extending lug members 77. The lug members 77 are preferably equally spaced about the circumference of the cylindrical portion of the neck 68 and have a generally elongated, curvilinear shape. More particularly, the lug members 77 preferably have a leading portion angled upwardly toward the opening 60, an intermediate portion that is substantially linear along a horizontal plane, and a trailing portion that is angled downwardly relative to the opening 60.

A cap 80 is provided to seal the opening. The cap 80 includes a side wall portion 82 closed at one end by a top panel 84. An inner wall of the side wall portion 82 is threadless, instead having one or more radially inwardly extending mating lugs 88, preferably a plurality of spaced mating lugs 88 corresponding to the number of lug members 77 on the neck 68. In use, the cooperating mating lugs 88 of the cap 80 and the lug members 77 of the neck 68 draw the top panel 82 against the curled flange 76 of the neck 68. The seal is generally an annular O-ring 89 molded as a peripheral part of a thin polymeric disk which is attached to the underside of top panel 84.

As illustrated in FIGS. 1-8 each side wall 82 associated with the caps 80 of the present invention has a three-part structure unlike any known in the art. The circumferential side wall panel 82 is integral with an outer peripheral edge of the top panel 84 and has a first segment 90 extending downwardly, a second segment 92 extending radially outwardly at a first angle to the first segment 90, and a third segment 96 extending downwardly from the second segment 92 at a second angle to the second segment 92. The seal material terminates at an intersection between the top panel 84 and the side wall 82. Each of these segments is preferably circumferential.

The first segment 90 of the circumferential side wall extends downwardly and preferably extends downwardly and substantially parallel to the longitudinal axis 50 such that an inner surface of the first segment lies adjacent a radially outer portion of the flange 76. The first segment 90 is preferably circumferential.

The second segment 90 is also preferably circumferential. The second segment 92 has a greater length than a length of the first segment 90. The second segment 92 is separated from the first segment 90 by a concave bend 98 having a center of curvature located radially outwardly of the concave bend 98. The second segment 92 is separated from the third segment 96 by a convex bend 100 having a center of curvature located radially inwardly of the convex bend 100. The angle of the second segment 92 (i.e., the first angle described above) as measured from an axis parallel to the longitudinal axis 50 is less than 90 degrees and greater than 0 degrees, more preferably the first angle is less than or equal to 60 degrees and greater than or equal to 20 degrees, or any range or combination of ranges therein.

The second segment 92 preferably has a shape for improved sealing with the center panel 18. Located between the concave bend 98 and the first convex bend 100 is a second convex bend 101. This second convex bend has a radius of curvature much greater than the radii of curvature of either concave bend 98 or the first convex bend 100. The center of curvature of the second convex bend 101 is located radially inwardly of the second convex bend 101. The location of the second convex bend 101 and its radius of curvature are adapted, as in sized, shaped, and located, to coincide with a portion of the shoulder 72 of the center panel 18 for improved sealing against the shoulder if so desired. In other words, one aspect of the present invention is to improve sealing of the cap 80 against the can end 10 by compressing a seal against an arcuate upper portion of the shoulder 72. Sealing material, such as an O-ring, may be located in this region of the second segment 92 to further improve sealing of a container.

Stated another way, the circumferential sidewall 82 has an angled portion located between a pair of convex bends. The lower of the two convex bends is the convex bend 100 between the second and third segments 92,96. The upper of the two convex bends is a bend created at the transition between the top panel 84 and the sidewall 82 where the cap 80 wraps around the flange 75. This bend separate the top panel 84 from the first segment 90 of the sidewall 82. This angled portion preferably extends both downwardly and outwardly relative to the longitudinal axis 50, and preferably includes the concave bend 98 along its length. Also included along the length of this angled portion is the second convex bend 101. The second convex bend 101 has a radius of curvature much greater than the other bends and substantially matches the radius of curvature of the upper arcuate shoulder 72 to provide improved sealing therewith.

The third segment 96 is also preferably circumferential. Much of the third segment 96 is generally vertical or parallel to the longitudinal axis along much of its length wherein the third segment 96 has an upper portion which is substantially parallel to the longitudinal axis and joined to the second segment 92. However, at least portions of the circumferential third segment 96 terminate at a radially outwardly formed curl 102. The phrase "radially outwardly formed" in this case is merely intended to indicate the radial directed in which a circumferential edge of the side wall 82 is deformed in order to create the curl 102. This curl 102 also forms an annular tube, portions of which are reformed or flattened to form the mating lugs 88. A portion of the radially outwardly formed curl 102 is located radially inwardly of a lowermost end of the third segment joined to the curl 102. This structure forms the mating lugs 88.

Figure 2:
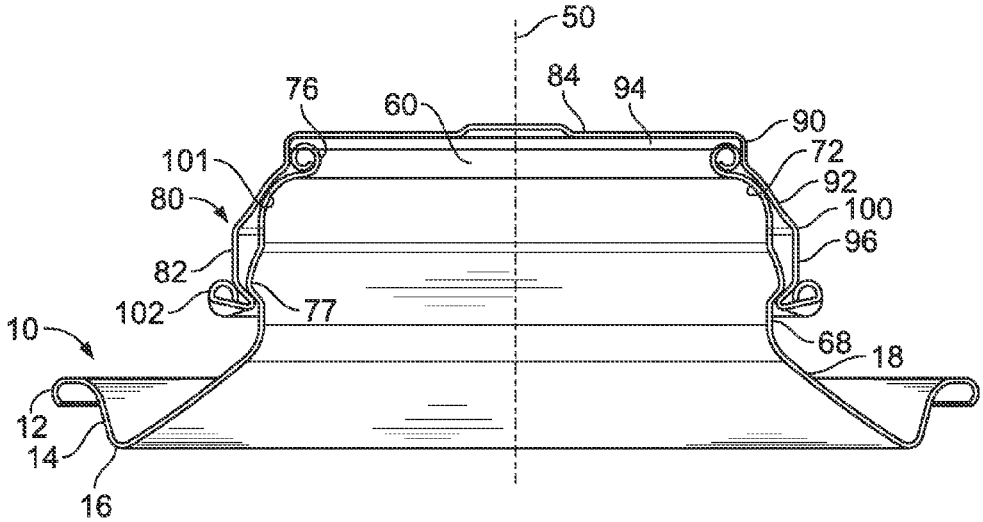
FIG. 2 is a cross-sectional view of a can end incorporating the first embodiment cap closure.
Figure 3:
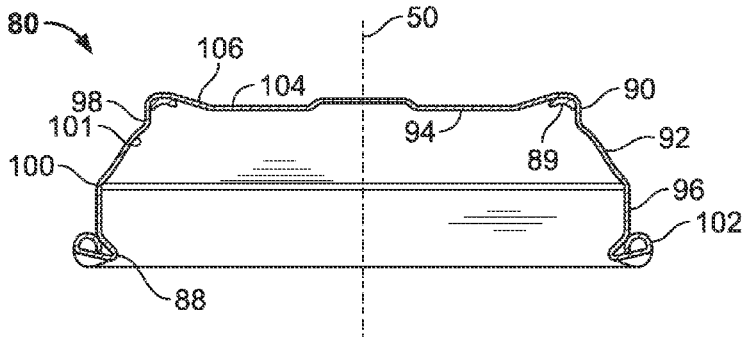
FIG. 3 is a cross-sectional view of a second embodiment cap closure of the present invention.
Figure 4:
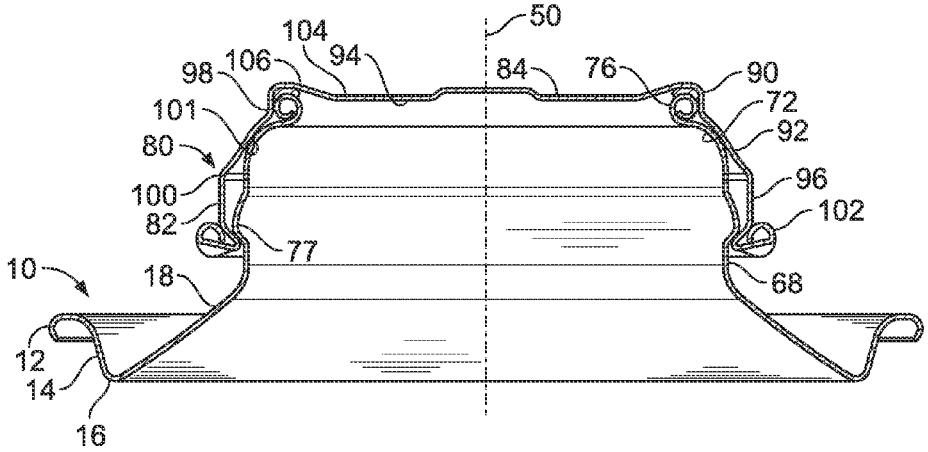
FIG. 4 is a cross-sectional view of a can end incorporating the second embodiment cap closure.

In the embodiment illustrated in FIGS. 3 and 4, in addition to the features described in conjunction with FIGS. 1 and 2, the top panel 80 has a recessed countersink 104 located radially inwardly from the peripheral edge of the top panel 84. A radially outer annular wall 106 of the countersink 104 angles downwardly and radially inwardly relative to the longitudinal axis 50. The annular wall 106 creates a vertical displacement of the countersink 104 that is greater than twenty-five percent of a vertical displacement created by the first segment 90. The combination of the first segment 90 of the side wall 82 and the outer annular wall 106 forms an annular channel for receiving the flange 76 therein. An o-ring sealing material is located within the channel.

Figure 5:
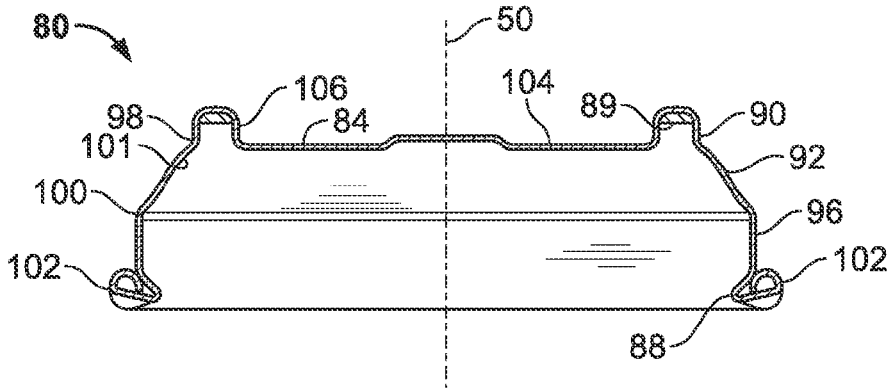
FIG. 5 is a cross-sectional view of a third embodiment cap closure of the present invention.
Figure 6:
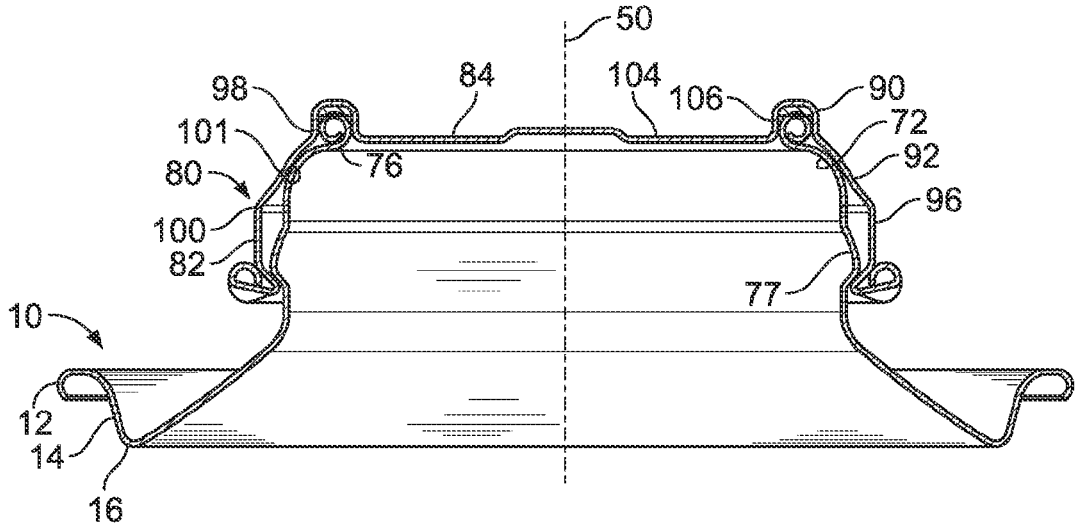
FIG. 6 is a cross-sectional view of a can end incorporating the third embodiment cap closure.
Figure 7:
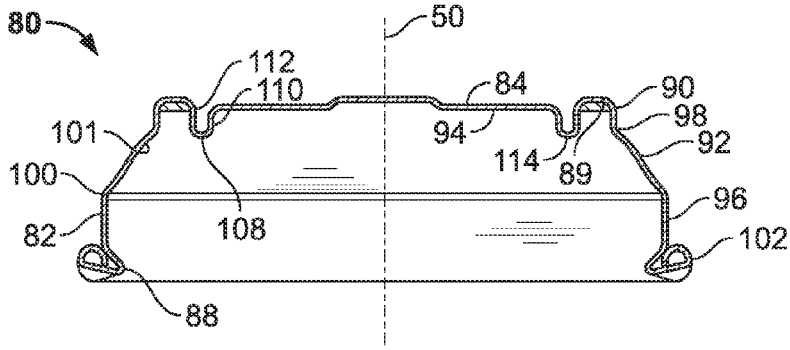
FIG. 7 is a cross-sectional view of a fourth embodiment cap closure of the present invention.

In the embodiment illustrated in FIGS. 5 and 6, in addition to the features described in conjunction with FIGS. 1 and 2, the radially outer annular wall 106 of the countersink 104 is substantially vertical and parallel to the longitudinal axis 50. Here, the annular wall 106 creates a vertical displacement of the countersink 104 that is greater than twenty-five percent of a vertical displacement created by the first segment 90, preferably equal to or greater than the total vertical displacement created by the first segment 90. The combination of the first segment 90 of the side wall 82 and the outer annular wall forms a deep annular channel having parallel annular walls of the first segment 90 of the cap side wall 82 and the outer annular wall 106 of the top panel 80. The channel is adapted, as in sized and shaped, to receive the flange 76 therein. An o-ring sealing material is located within the channel.

Figure 8:
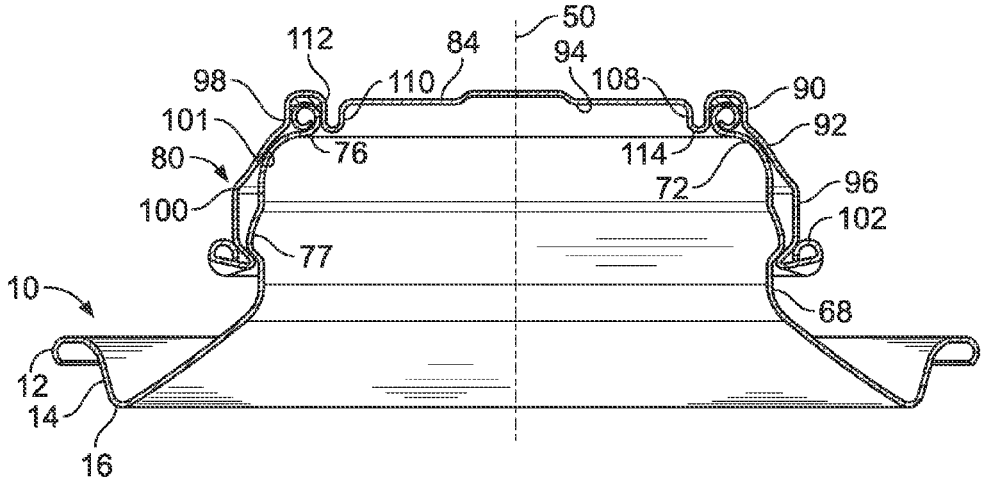
FIG. 8 is a cross-sectional view of a can end incorporating the fourth embodiment cap closure.
Figure 9:
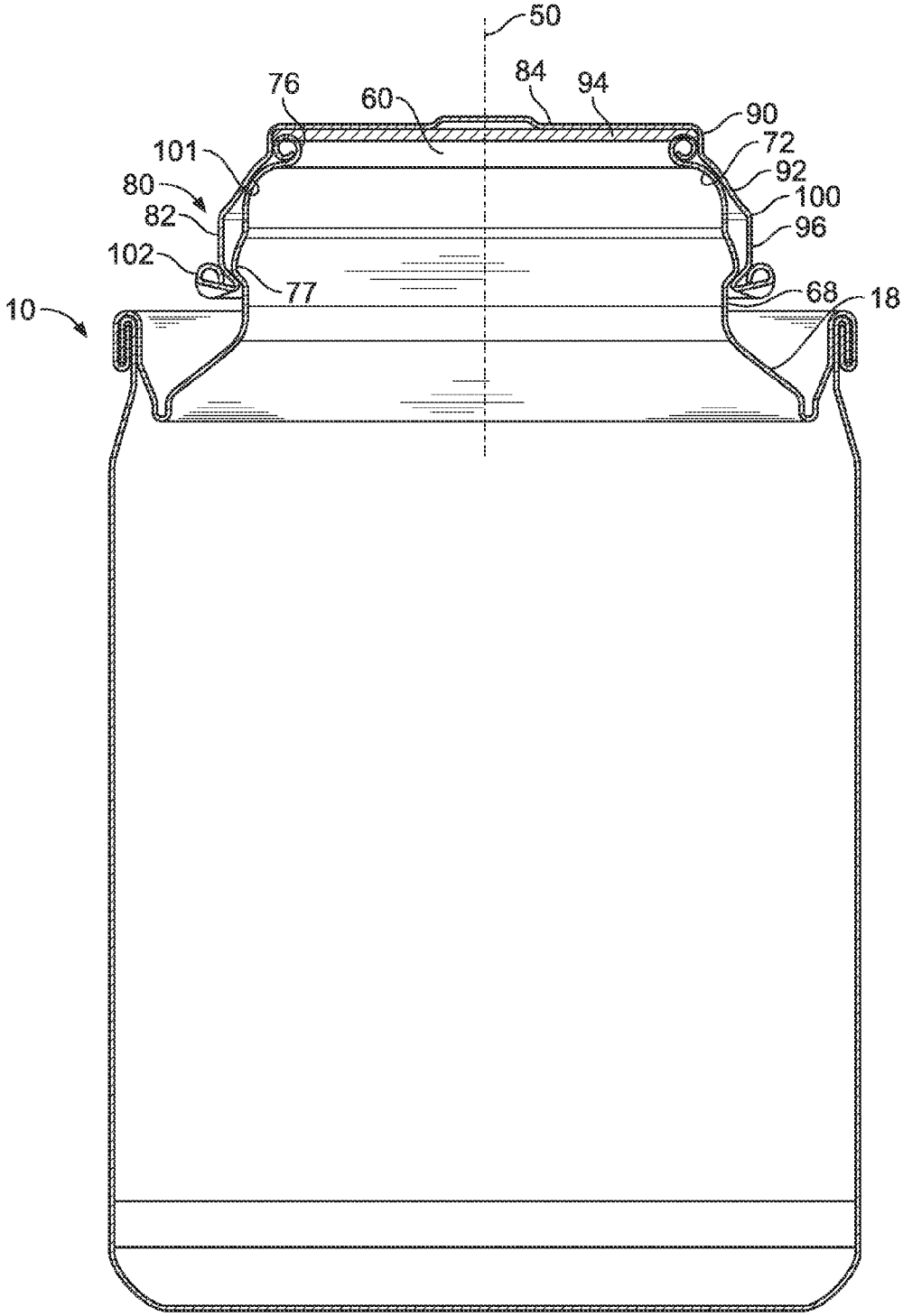
FIG. 9 is a cross-sectional of a container view of a can end seamed to a container body.

In the embodiment illustrated in FIGS. 8 and 9, in addition to the features described in conjunction with FIGS. 1 and 2, the top panel 80 includes an annular recessed countersink 108. This countersink 108 is generally U-shaped. Accordingly, the countersink 108 has substantially parallel radially inner and outer annular walls 110, 112 joined by an annular arcuate segment 114. The outer annular wall 112 creates a vertical displacement of the countersink 108 that is greater than twenty-five percent of a vertical displacement created by the first segment 90, preferably equal to or greater than the total vertical displacement created by the first segment 90. A portion of the top panel 80 located radially inwardly from the annular recessed countersink 108 is located below a height of the outer peripheral edge of the top panel 80. A combination of the outer annular wall 112 and the first segment 90 of the cap side wall 82 forms a channel for receiving the flange 76 therein. An o-ring sealing material again is located within the channel.

The lug-type closure assembly provides advantages over prior art threaded closures. First, the cap 80 of the lug-type closure assembly is easier to reseal on the can end 10. Threaded caps requires several turns to reseal a beverage within the containment vessel; the lug-type assembly only requires a partial turn dictated by the length of the linear portion of the lug member on the neck. Second, the lug-type assembly is easier to manufacture because the lugs can be larger than typical threads, and the lugs do not need to spiral about the entire circumference of the neck and/or vertically overlap like typical threads. Third, the lug-type assembly does not require an annular ring from which the cap must be separated to open the container or perforated metal tabs to form a seal with the can end.

Figure 10:
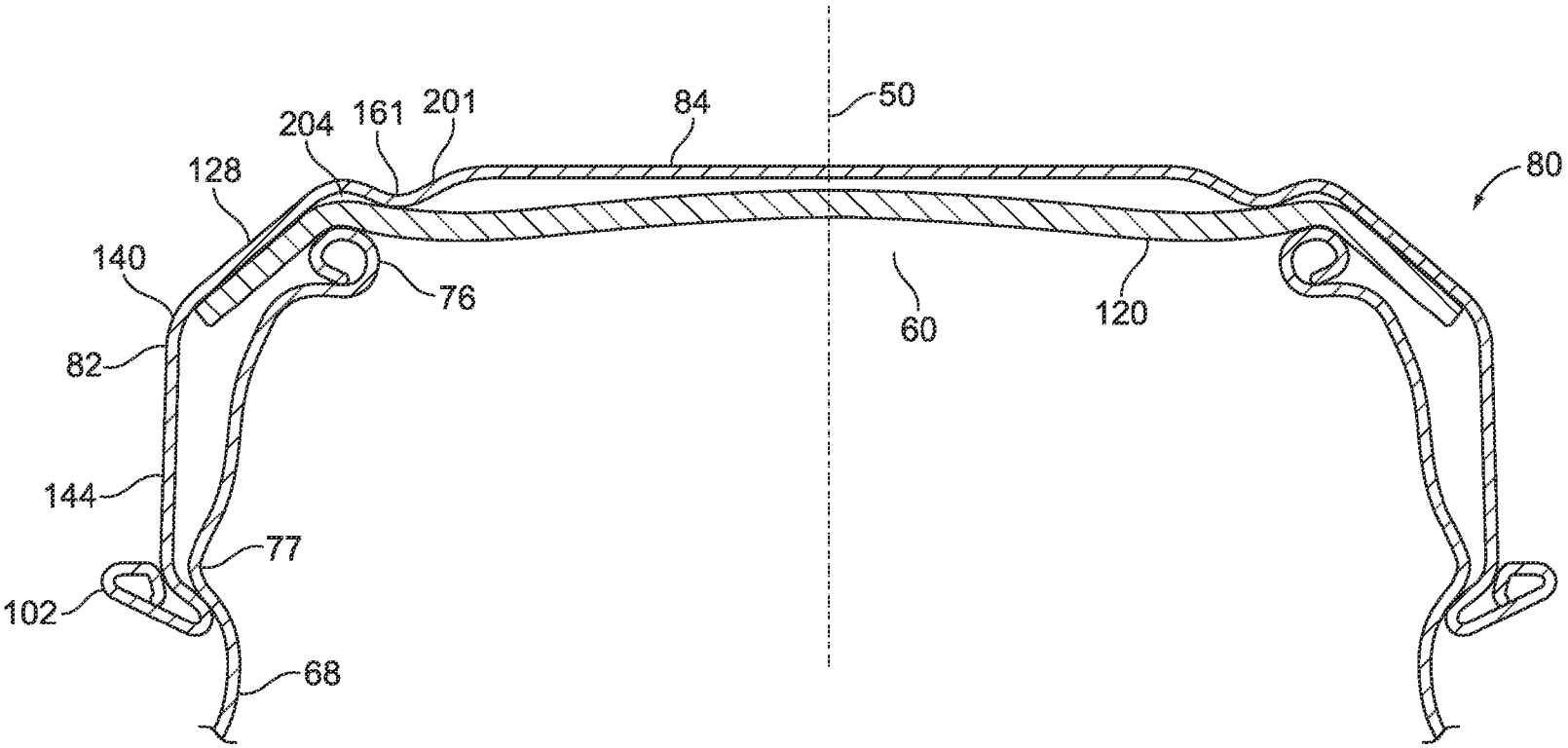
FIG. 10 is a cross-sectional view of a commercially available cap attached to a commercially available flange.

As stated above, typical commercial caps of the type discussed herein below a polymeric disk 120 to help seal the beverage within the container. The disks 120 in the commercial caps 80 are typically much larger in diameter than the top panel 84 and extend at an angle downwardly along the side wall portion 82. The inventors discovered that these commercial caps 80 have not been viable for beverages requiring a pasteurization process due to concern with maintaining adequate leakage pressure performance. The inventors further discovered that the disks 120 of these commercial caps 80 tend to be in tension, rather than compression. A partial cross-sectional view of a commercial cap 80/neck 68 interface is illustrated in FIG. 10. The inventors further altered the cap 80 design to increase compression of the disk 120 between the cap 80 and the neck 68.

Figure 11:
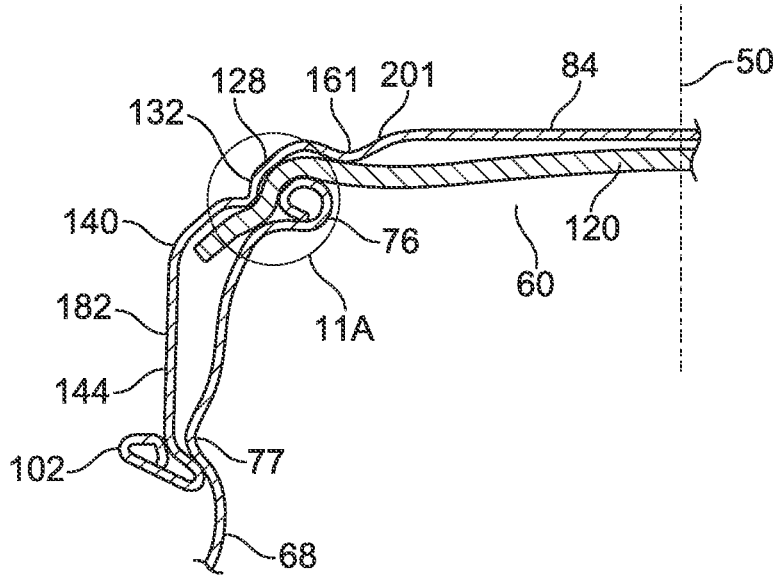
FIG. 11 is a partial cross-sectional view of an embodiment of the present invention.
Figure 11A:
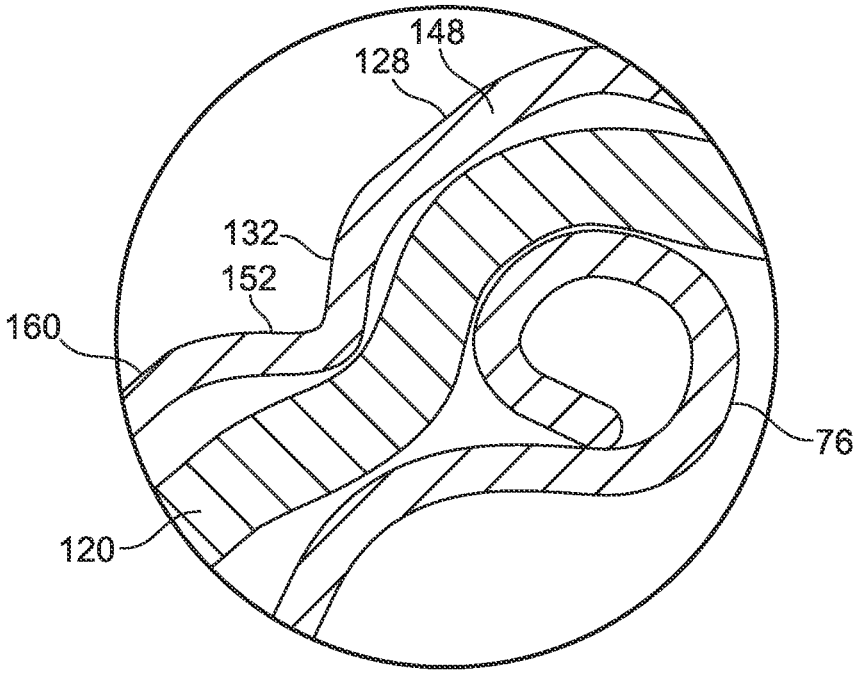
FIG. 11A is a magnified view of a portion of FIG. 11.
Figure 12:
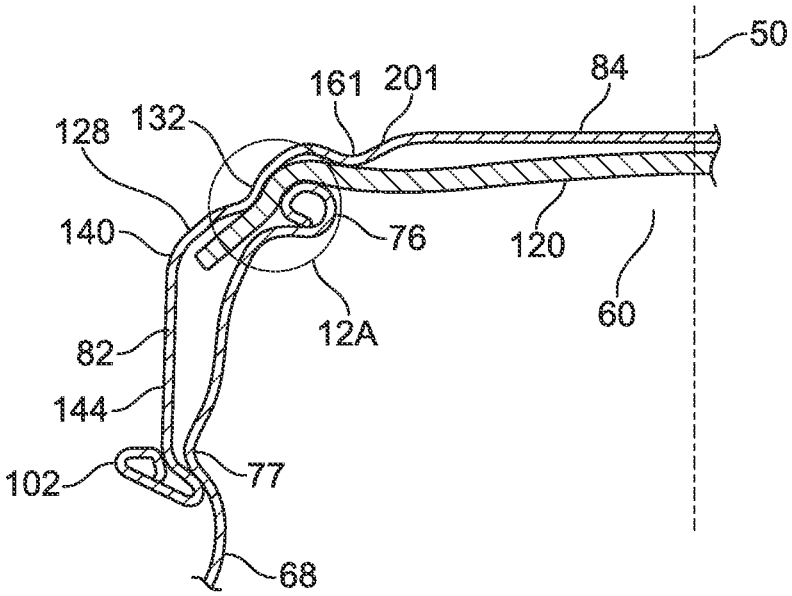
FIG. 12 is a partial cross-sectional view of an embodiment of the present invention.
Figure 12A:
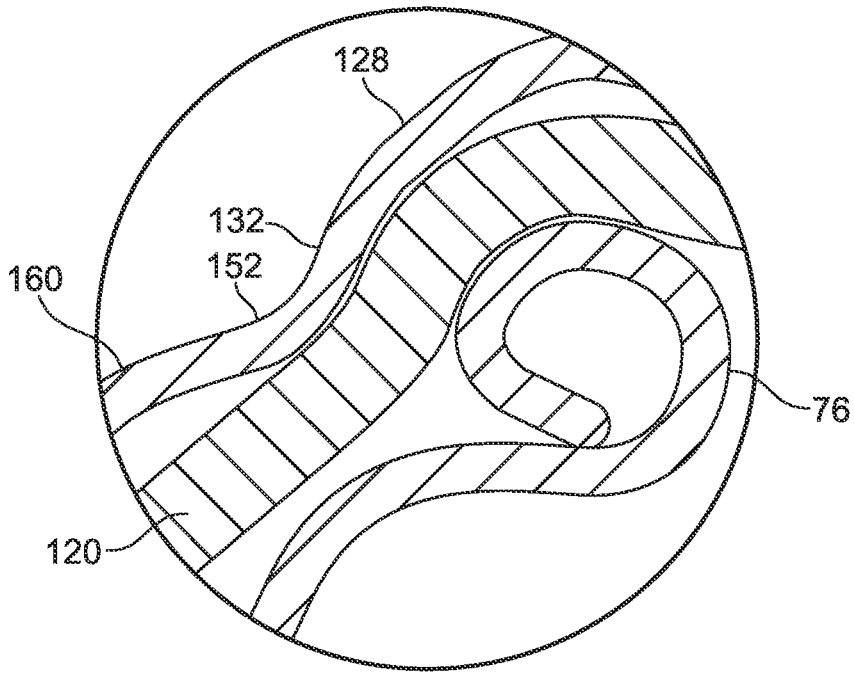
FIG. 12A is a magnified view of a portion of FIG. 12.

In one embodiment illustrated in FIG. 11-12, a bead 124 was added to side wall portion 82 of the cap 80. In the embodiment illustrated, the side wall 82 has a first part 128 extending downwardly and radially outwardly at an angle greater than 90° to the top panel 84. A bead 132 is formed in the first part 128. The bead 132 is preferably circumferential but may comprise a plurality of the individual beads spaced about the circumference of the first part 128, preferably equally spaced. Each bead 132 has a radius of curvature forming a radially inwardly concave bend on the first part 128 between a first outwardly convex bend 136 joining the first part 128 with the top panel 84 and a second outwardly convex bend 140 joining the first part 128 with a lower second part 144 of the side wall 82 extending downwardly and similarly constructed to that of the third segment 96 of the previous embodiments.

More particularly, the bead 132 separates the first part 128 into three segments. A first segment 148 is directly joined to the top panel 84 and extends downwardly and radially outwardly from the outer peripheral edge of the top panel 84. A second segment 152 comprising a radially inwardly concave segment 156 extends downwardly and further outwardly from the first segment 148. A third segment 160 extends downwardly and radially outwardly from a lowermost portion of the second segment 152 and is joined to the second part 144 of the side wall 82.

Caps 80 according to this embodiment were produced according to the variables set forth in Table 1:

TABLE 1

Variable List

| Variable | Bead Radius | Bead Depth |
|---|---|---|
| 1 | 0.730 ins (1.85 cm) | 0.040 ins (0.102 cm) |
| 2 | 0.730 ins (1.85 cm) | 0.030 ins (0.076 cm) |
| 3 | 0.700 ins (1.78 cm) | 0.030 ins (0.076 cm) |
| 4 | 0.700 ins (1.78 cm) | 0.020 ins (0.051 cm) |

Generally, in this embodiment, the radially inwardly concave bead 132 may have a bead radius, as measured from the longitudinal axis 50, between 0.700 inches and 0.730 inches (1.78 cm to 1.85 cm) and a bead depth between 0.020 inches and 0.040 inches (0.051 cm to 0.102 cm), as measured from a public side of a lowermost point 161 of a peripheral edge of the top panel 84, typically within a recessed circumferential bead. The inventors further contemplate bead radii of curvature as low as 0.006 inches to 0.072 inches (0.015 cm to 0.183 cm), more preferably between 0.006 inches to 0.036 inches (0.015 cm to 0.091 cm). The radii of curvature of a pair of outwardly convex bends bordering the bead are preferably between 0.050 inches to 0.090 inches (0.127 cm to 0.223 cm).

The caps 80 were attached to containers 10, and performance of the caps was compared against commercial control caps. Results are summarized in Table 2.

TABLE 2

On Torque and Leakage Pressure Testing

| Variable | Sample | On Torque (in * lb) | Leak Pressure (psig) |
|---|---|---|---|
| Control | C-1 | 20 | 86 |
| | C-2 | 17 | 98 |
| | C-3 | 16 | 95 |
| | C-4 | 17 | 72 |
| | C-5 | 17 | 100 |
| | C-6 | 17 | 90 |
| | C-7 | 18 | — |
| | C-8 | 19 | — |
| | Average | 17.6 | 93.8 |
| Variable #1 | #1-1 | 25 | 113 |
| | #1-2 | 24 | 118 |
| | #1-3 | 24 | 121 |
| | #1-4 | 27 | 112 |
| | #1-5 | 25 | — |
| | #1-6 | 26 | — |
| | #1-7 | 28 | 118 |
| | #1-8 | 28 | 119 |
| | Average | 25.9 | 116.8 |
| Variable #2 | #2-1 | 22 | 114 |
| | #2-2 | 22 | 112 |
| | #2-3 | 26 | 113 |
| | #2-4 | 26 | — |
| | #2-5 | 25 | — |
| | #2-6 | 27 | 111 |
| | #2-7 | 27 | 100 |
| | #2-8 | 24 | 113 |
| | Average | 24.9 | 110.5 |
| Variable #3 | #3-1 | 31 | 114 |
| | #3-2 | 32 | 115 |
| | #3-3 | 26 | 118 |
| | #3-4 | 30 | — |
| | #3-5 | 31 | — |
| | #3-6 | 29 | 114 |
| | #3-7 | 32 | 114 |
| | #3-8 | 34 | 118 |
| | Average | 30.6 | 115.5 |

TABLE 2-continued

On Torque and Leakage Pressure Testing

| Variable | Sample | On Torque (in * lb) | Leak Pressure (psig) |
|---|---|---|---|
| Variable #4 | #4-1 | 24 | 114 |
| | #4-2 | 26 | 112 |
| | #4-3 | 26 | 109 |
| | #4-4 | 28 | 102 |
| | #4-5 | 25 | — |
| | #4-6 | 24 | — |
| | #4-7 | 22 | 106 |
| | #4-8 | 24 | 112 |
| | Average | 24.9 | 109.2 |

Based on the results, the inventors found that Variable No. 1 having a bead radius of 0.730 inches and a bead depth of 0.040 inches performed the best in on-torque (25.9 in*lbs) and leak pressure (116.8 psig).

For each of the bead designs, it was noticed from the cross-sections that the amount of disk 120 compression from side to side was significantly different. It was also noted that during the on-torque (or application) of these caps 80, in some cases, the caps 80 appeared tilted or "cocked" on top of the container 10.

Additionally, the disk 120 material appeared to be "stretched" across the top of the cap 80, and did not flow naturally as seen in the control. The inventors believe this tension on the disk 120 could increase the on-torque values unnecessarily. Therefore, the inventors contemplate use of a disk 120 having a center portion removed to fabricate a "ring."

A reduction in on-torque may also be achieved by increasing the top load during the capping process. Typically, 40 lbs. is used, however, the inventors foresee applying as much as 60 lbs. or 80 lbs. of top load.

It was observed that due to the increased re-shaping of the disk 120 with these cap designs, that the disk 120 may have an even more increased tendency to "fall out" of the cap 80 after pasteurizing. One suggestion was to develop a "locking bead" into the cap 80 so that when the disk 120 was inserted into the cap 80, the locking bead would hold the disk in place.

According to testing of caps 80 made according to the previous embodiment incorporating a preferred of geometry 0.730 inches (1.85 cm) bead radius and 0.040 inches (0.102 cm) bead depth was performed. The inventors further tested the effects of various disk materials, disk geometry and capping conditions in conjunction with the preferred beaded cap design. Of course, the inventors contemplate that any of the variations discussed above could be used in combination with any of the disk materials, disk geometries, and capping conditions set forth below. The results of the study are set forth in Table 3.

TABLE 3

On-Torque and Leak Pressure Data for Variables #1-10

| Variable | Liner Material | Liner Thickness | Top Load (lbs) | Sample | On-Torque (in*lb) | Leak Pressure (psig) | Comment |
|---|---|---|---|---|---|---|---|
| 1 | EVA (Control) | 0.036 ins (0.091 cm) | 40 | 1 | 25 | 117 | |
| | | | | 2 | 25 | | |
| | | | | 3 | 28 | 113 | |
| | | | | 4 | 27 | 115 | |
| | | | | 5 | 26 | 115 | |
| | | | | 6 | 24 | | |
| | | | | 7 | 22 | 118 | |
| | | | | 8 | 27 | 109 | |
| | | | | 9 | 26 | 113 | |
| | | | | 10 | 24 | 121 | Cap Release from Top Dome Buckle |
| | | | | AVG | 25.4 | 115.1 | |
| 2 | EVA (Control) | 0.036 ins (0.091 cm) | 60 | 1 | 21 | 120 | Cap Release from Top Dome Buckle |
| | | | | 2 | 21 | | |
| | | | | 3 | 22 | 117 | |
| | | | | 4 | 22 | 122 | Cap Release from Top Dome Buckle |
| | | | | 5 | 24 | 120 | Cap Release from Top Dome Buckle |
| | | | | 6 | 22 | | |
| | | | | 7 | 21 | 118 | Cap Release from Top Dome Buckle |
| | | | | 8 | 26 | 119 | |
| | | | | 9 | 22 | 120 | |
| | | | | 10 | 22 | 119 | |
| | | | | AVG | 22.3 | 119.4 | |
| 3 | EVA (Control) | 0.036 ins (0.091 cm) | 80 | 1 | 19 | 120 | |
| | | | | 2 | 19 | | |
| | | | | 3 | 21 | 122 | Cap Release from Top Dome Buckle |
| | | | | 4 | 23 | 115 | |
| | | | | 5 | 21 | 115 | |
| | | | | 6 | 22 | | |
| | | | | 7 | 18 | 118 | |
| | | | | 8 | 24 | 93 | Cap Release from Bottom Dome Buckle |
| | | | | 9 | 20 | 121 | |
| | | | | 10 | 19 | 114 | |
| | | | | AVG | 20.6 | 117.9 | |

TABLE 3-continued

On-Torque and Leak Pressure Data for Variables #1-10

| Variable | Liner Material | Liner Thickness | Top Load (lbs) | Sample | On-Torque (in*lb) | Leak Pressure (psig) | Comment |
|---|---|---|---|---|---|---|---|
| 4 | EVA (RING) | 0.036 ins (0.091 cm) | 40 | 1 | 28 | 110 | |
| | | | | 2 | 23 | | |
| | | | | 3 | 23 | 121 | Cap Release from Top Dome Buckle |
| | | | | 4 | 23 | 104 | |
| | | | | 5 | 22 | 120 | Cap Release from Top Dome Buckle |
| | | | | 6 | 29 | | |
| | | | | 7 | 22 | 120 | |
| | | | | 8 | 28 | 113 | |
| | | | | 9 | 30 | 114 | |
| | | | | 10 | 29 | 108 | |
| | | | | AVG | 25.7 | 113.8 | |
| 5 | EVA (Silgan) | 0.029 ins (0.737 cm) | 40 | 1 | 23 | 112 | |
| | | | | 2 | 24 | | |
| | | | | 3 | 18 | 110 | |
| | | | | 4 | 21 | 110 | |
| | | | | 5 | 22 | 111 | |
| | | | | 6 | 22 | | |
| | | | | 7 | 22 | 109 | |
| | | | | 8 | 18 | 111 | |
| | | | | 9 | 20 | 107 | |
| | | | | 10 | 19 | 115 | |
| | | | | AVG | 20.9 | 110.6 | |
| 7 | GLS | 0.035 ins (0.089 cm) | 40 | 1 | 47 | 102 | |
| | | | | 2 | 43 | | |
| | | | | 3 | 42 | 102 | |
| | | | | 4 | 44 | 100 | |
| | | | | 5 | 57 | 100 | |
| | | | | 6 | 43 | | |
| | | | | 7 | 46 | 72 | Vented, Partial Unthread from Bottom Dome Buckle |
| | | | | 8 | 47 | 93 | |
| | | | | AVG | 46.1 | 99.4 | |
| 8 | GLS | 0.031 ins (0.079 cm) | 40 | 1 | 38 | 86 | |
| | | | | 2 | 37 | | |
| | | | | 3 | 38 | 96 | |
| | | | | 4 | 37 | 95 | |
| | | | | 5 | 39 | 65 | Cap Release from Bottom Dome Buckle |
| | | | | 6 | 42 | | |
| | | | | 7 | 42 | 83 | |
| | | | | 8 | 36 | 91 | |
| | | | | AVG | 38.6 | 90.2 | |
| 9 | WPP SOR | 0.042 ins (0.107 cm) | 40 | 1 | 35 | 92 | Cap Release No Obvious Reason |
| | | | | 2 | 46 | | |
| | | | | 3 | 39 | 120 | Cap Release from Top Dome Buckle |
| | | | | 4 | 44 | 120 | |
| | | | | 5 | 43 | 113 | |
| | | | | 6 | 40 | | |
| | | | | 7 | 46 | 121 | Cap Release from Top Dome Buckle |
| | | | | 8 | 43 | 121 | Cap Release from Top Dome Buckle |
| | | | | 9 | 37 | 120 | Cap Release from Top Dome Buckle |
| | | | | 10 | 38 | 122 | Cap Release from Top Dome Buckle |
| | | | | AVG | 41.1 | 119.6 | |

TABLE 3-continued

On-Torque and Leak Pressure Data for Variables #1-10

| Variable | Liner Material | Liner Thickness | Top Load (lbs) | Sample | On-Torque (in*lb) | Leak Pressure (psig) | Comment |
|---|---|---|---|---|---|---|---|
| 10 | D0608 (Europe) | 0.036 ins (0.091 cm) | 40 | 1 | 31 | 101 | |
| | | | | 2 | 31 | | |
| | | | | 3 | 24 | 86 | |
| | | | | 4 | 25 | 81 | |
| | | | | 5 | 28 | 89 | |
| | | | | 6 | 25 | | |
| | | | | 7 | 30 | 97 | |
| | | | | 8 | 30 | 95 | |
| | | | | 9 | 28 | 97 | |
| | | | | 10 | 31 | 97 | |
| | | | | AVG | 28.3 | 92.9 | |

The inventors discovered that a ring-shaped liner performed similar to the disk-shaped liner with average on-torque values of 25.7 and 25.4 in-lbs, respectively, and average leak pressure values of 113.8 and 115.1 psi, respectively.

For the standard EVA liners, as the top load was increased, average on-torque decreased. Average on-torque values were 25.4, 22.3 and 20.6 in-lbs for top loads of 40, 60 and 80 lbs-f, respectively. Average leakage pressures were 115.1, 119.4 and 117.9 psi for 40, 60 and 80 lbs-f top load, respectively.

For the EVA liner material, a change in thickness from 0.036 inches to 0.029 inches resulted in a drop in average on-torque from 25.4 in-lbs to 20.9 in-lbs. Average leak pressure also dropped from 115.1 psi to 110.6 psi.

The trends were similar for the GLS liner material. A change in thickness from 0.035 inches to 0.030 inches resulted in a decrease in average on-torque from 46.1 in-lbs to 38.6 in-lbs. This also corresponded to a drop in average leakage pressure from 99.4 in-lbs to 90.2 in-lbs.

Average on-torque values for the EVA control material (0.036 inches) were the lowest of the materials tested at 25.4 in-lbs (for baseline 40 lbs-f top load). The GLS material produced very high average on-torque values of 46.1 in-lbs (0.035 inches) and 38.6 in-lbs (0.030 inches). The WPP SOR material (0.042 inches) also produced a high average on-torque value of 41.1 in-lbs. The D0608 material (0.036 inches) had reasonably low on-torque values of 28.3 in-lbs.

In terms of leakage pressure, the control EVA material and WPP SOR performed well with average leak pressures of 115.1 and 119.6 psi, respectively. The GLS material had an average leakage pressure of 99.4 psi (0.035 inches) and 90.2 psi (0.030 inches). The D0608 material (0.036 inches) produced an average leakage pressure of 92.9 psi.

In many cases, the seal was so effective that the closure did not leak until the top dome buckled causing release of the cap. This occurred in thirteen samples at pressures between 118-122 psi.

In two instances, the cap appeared to release prematurely from the shock of the bottom can dome buckling. This happened in Variable No. 3, Sample No. 8 and Variable No. 8, Sample No. 5. In one instance, Variable No. 7, Sample No. 7, the same occurrence is believed to have occurred but caused venting by only partial unthreading of the cap and not full release of the cap. In Variable No. 9, Sample No. 1, the cap released at a low pressure, but it was not coincident with dome buckling, and the reason for the occurrence is not known.

Figure 13:
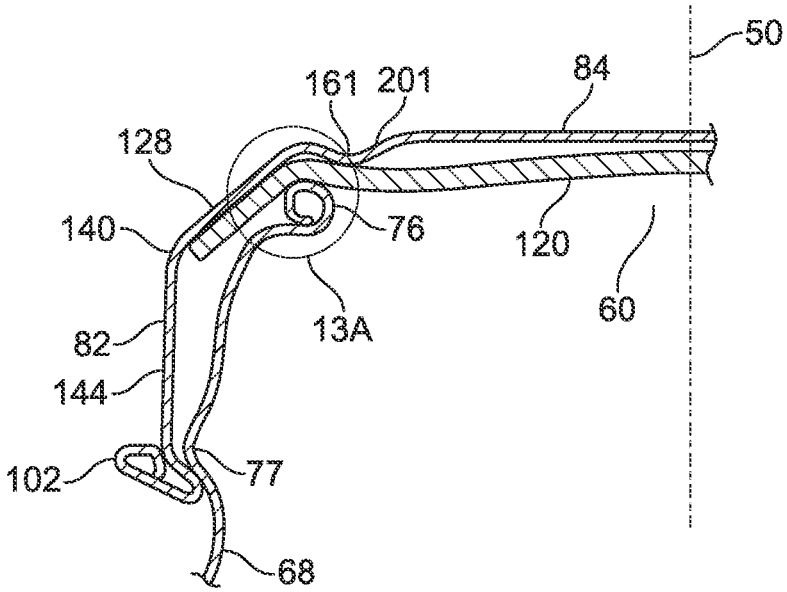
FIG. 13 is a partial cross-sectional view of an embodiment of the present invention.
Figure 13A:
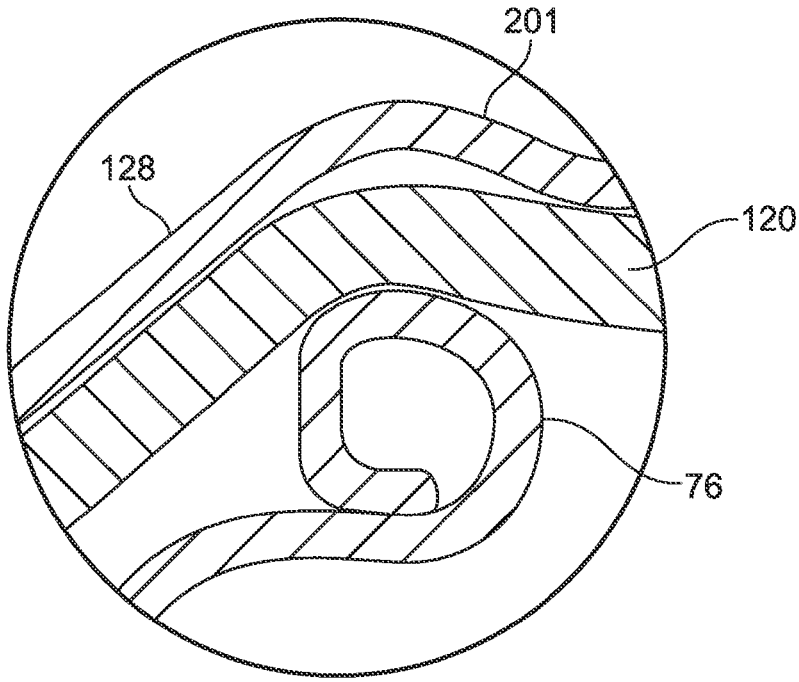
FIG. 13A is a magnified view of a portion of FIG. 13.

Another embodiment aimed at improving leak pressure is illustrated in FIG. 13. This embodiment may be used in combination with the caps 80 disclosed herein. In this embodiment, the curled flange 76 is altered such that a radially outward portion of the flange is flattened from having a curved cross-section shape to having a substantially vertical cross-sectional orientation. A flattened segment may a vertical length of about 0.018 inches to 0.024 inches (0.046 cm to 0.061 cm). Stated another way, the flange 76 may have an annular top segment having a radius is curvature less than a portion of the flange 76 located radially inwardly from the annular top segment such that a portion extending downwardly from the annular top segment extends downwardly at a steeper angle than if the radius of curvature remained constant in the flange 76, preferably the flattened portion being substantially vertical.

Figure 14:
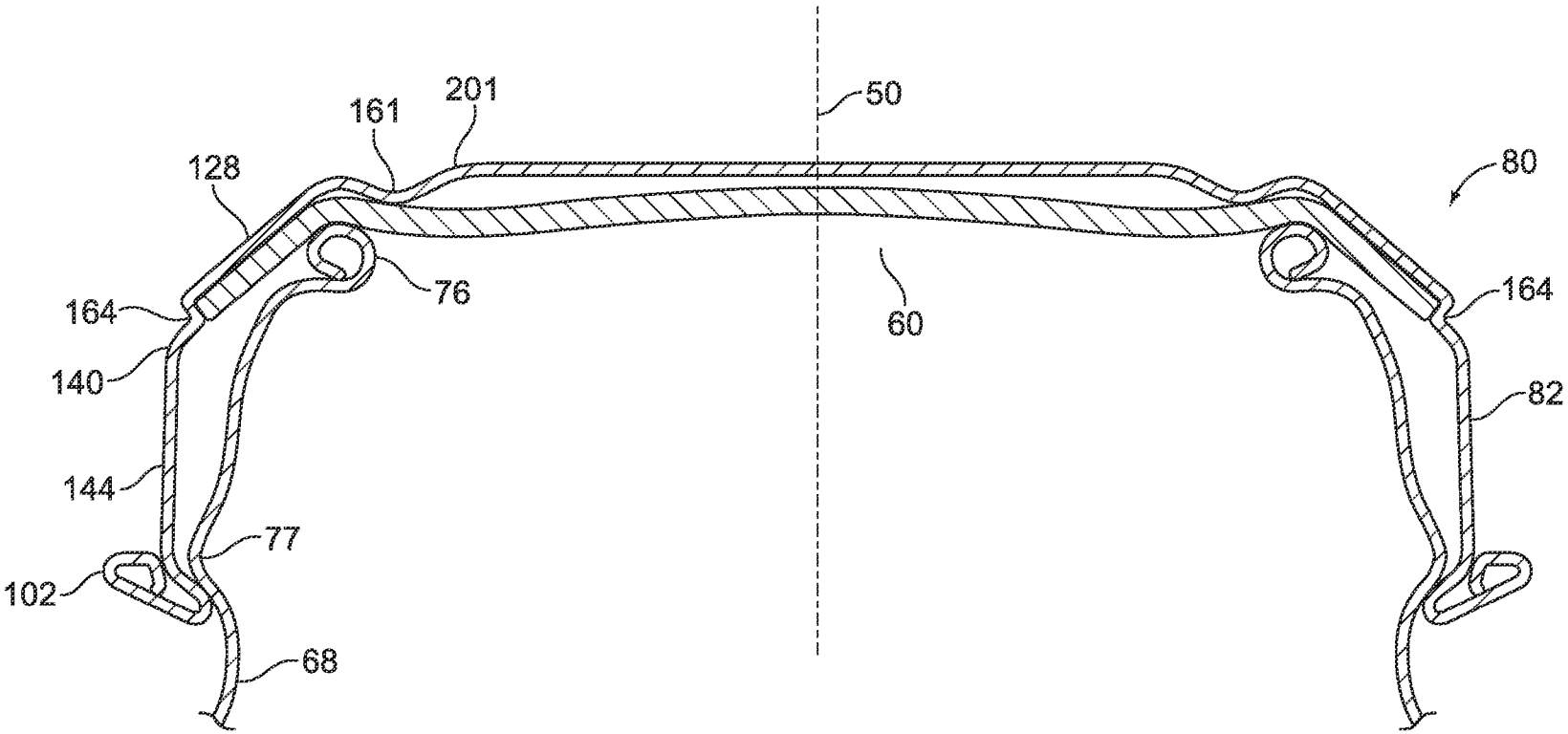
FIG. 14 is a partial cross-sectional view of an embodiment of the present invention.

Another embodiment aimed at improving leak pressure is illustrated in FIG. 14. This embodiment may be used in combination with the caps 80 disclosed herein. In this embodiment, inwardly concave dimples 164 may be formed about the circumference of the side wall 82. The dimples 164 are located just beneath the peripheral edge of the disk 120 on the side wall 82 of the cap 80. The dimples 164 prevent the disk 120 from sliding downwardly when the cap 80 is tightened on the neck 76.

Figure 15:
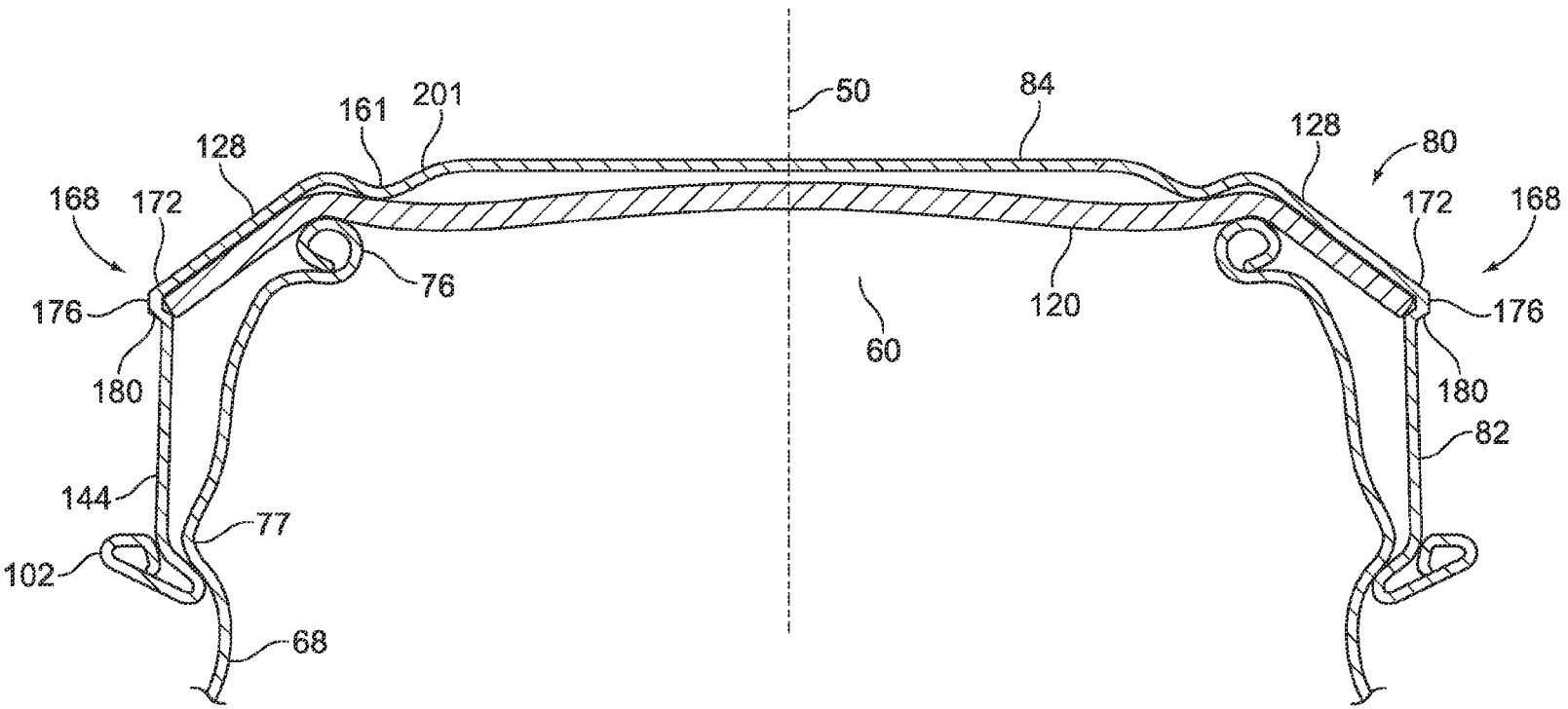
FIG. 15 is a partial cross-sectional view of an embodiment of the present invention.

A variation of the embodiment illustrated in FIG. 14 is illustrated in FIG. 15. Here, a transition between the first part 128 and the second part 144 of the side wall 82 is faceted to hold the outer peripheral edge of the disk 120 at a generally constant vertical position. Accordingly, a faceted portion 168 has at least two segments, preferably three segments. A first segment 172 angles downwardly from a lowermost edge of the first part 128 of the side wall 82 possibly at a slightly higher angle than the first part 128. A second segment angles 176 downwardly from the first segment 172, preferably at a higher angle than the first part 172, and most preferably at a substantially vertical orientation. A third segment angles 180 downwardly and radially inwardly from the second segment 176 wherein a pocket is formed between the first and third segments 172, 180 such that the peripheral edge of the disk 120 fits within the pocket and abuts the second segment 176. A lowermost portion of the third segment 180 is joined to the second part 144 of the side wall 82.

The embodiments illustrated in FIGS. 14 and 15 may be altered slightly wherein the dimples 164 and/or the faceted portion 168 are/is located at the transition between the top panel 84 and the first part 128 of the side wall 82. It follows that the disk 120 of these variations would have a somewhat smaller diameter.

Figure 16:
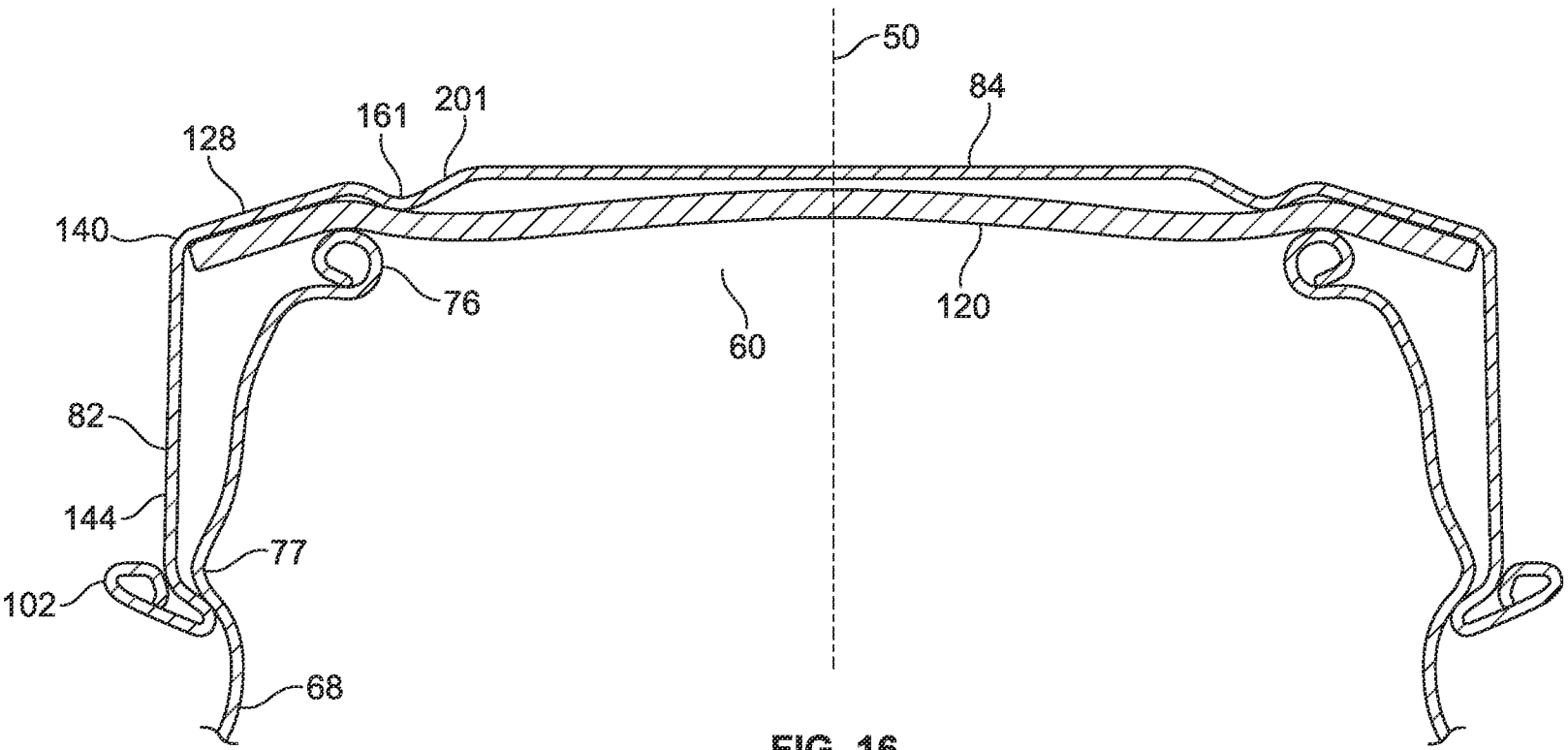
FIG. 16 is a partial cross-sectional view of an embodiment of the present invention.

Another embodiment is illustrated in FIG. 16. In this embodiment, the angle of the first part 128 of the side wall 82 is reduced wherein the disk 120 would undergo less deformation during the pasteurization process. A commercially available cap 80 illustrated in FIG. 10 has a first part 144 angle of about 40° from the vertical. Therefore, the angle of the first part 144 in this embodiment is preferably less than 40°, more preferably less than 35°, still more preferably less than 30°, and most preferably between 10° and 25°.

Another embodiment requires reducing the lug diameter with corresponding dome changes. This design increases the differential between the disk 120 and the lugs. Another way of accomplishing this would be to maintain the diameter of the lugs while enlarging the diameter of the remaining portions of the side wall 82 to increase the differential disk 120 diameter relative to the lug diameter.

Figure 17:
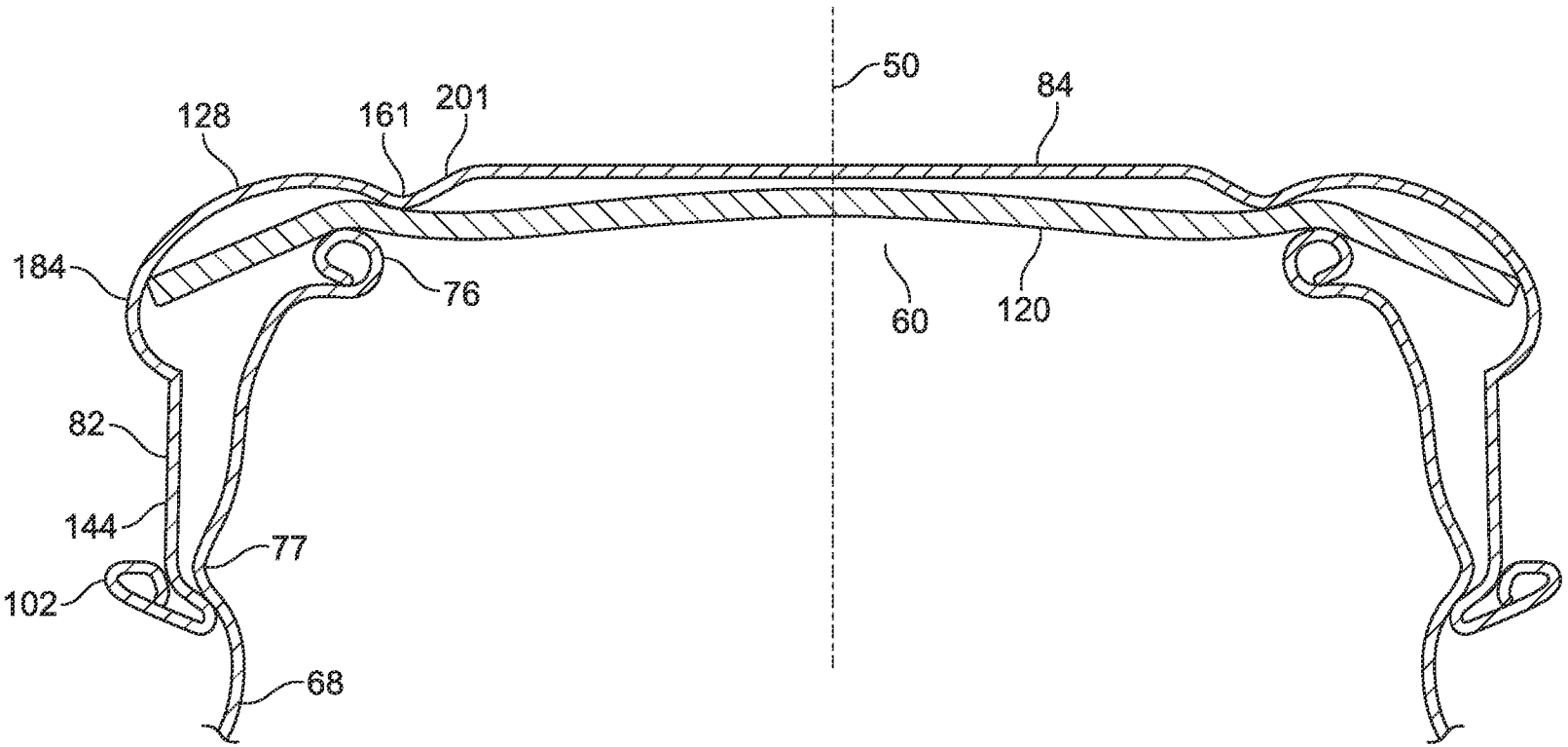
FIG. 17 is a partial cross-sectional view of an embodiment of the present invention.

A mushroomed cap 80 is illustrated in FIG. 17. In this embodiment, a circumferential channel 184 is formed in the side wall 82. The channel 184 has a greater diameter than portions of the side wall 82 bordering the channel 184 at opposite ends of the channel 184 such that the cap 80 has slight mushroomed shape.

Figure 18:
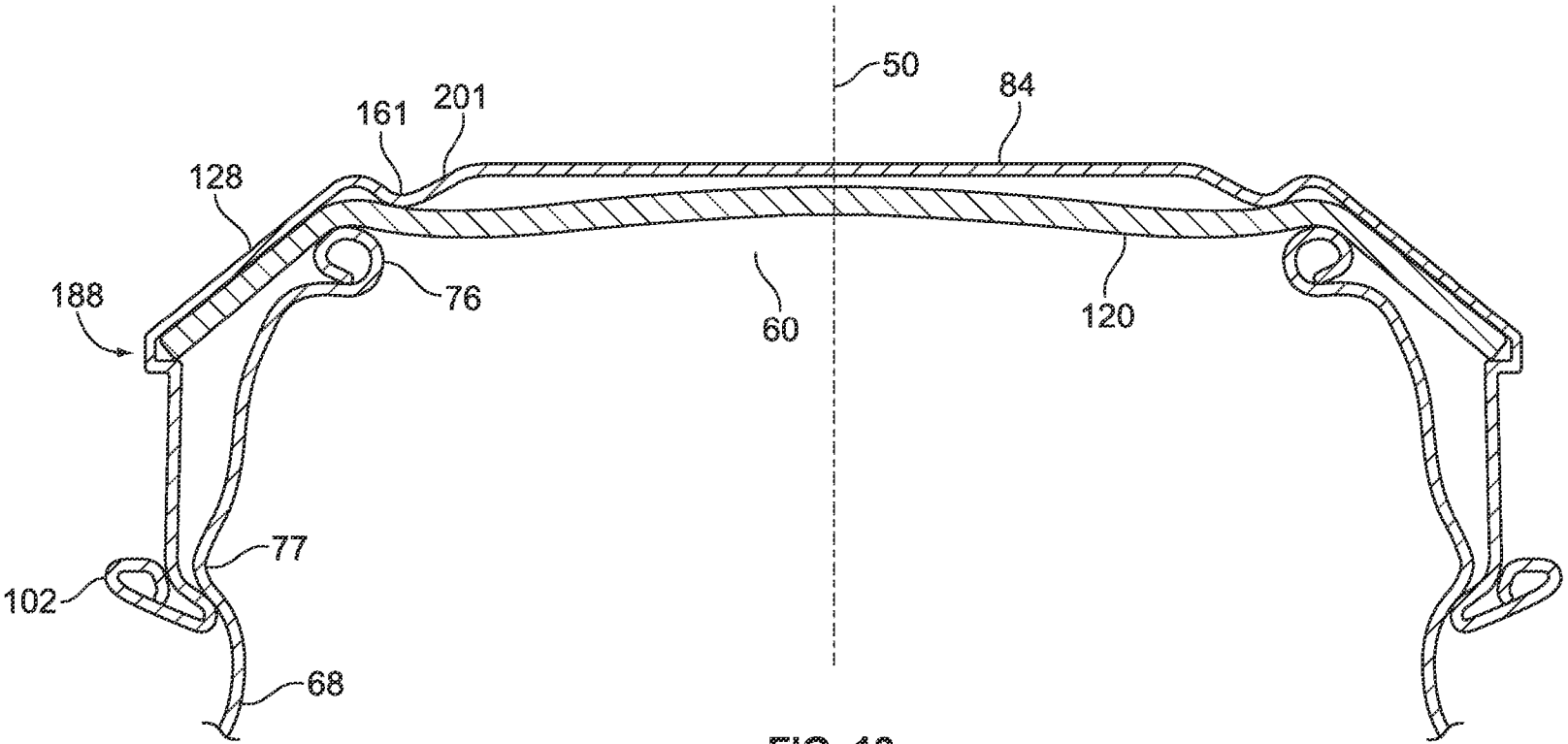
FIG. 18 is a partial cross-sectional view of an embodiment of the present invention.

A variation of the embodiment illustrated in FIG. 17 is illustrated in FIG. 18. Here, a circumferential step 188 is formed in the side wall 82 such that the portion of the side wall 82 below the step has a smaller diameter than the step 188. Stated another way, a radially outwardly directed bend is formed in the side wall 82 such that a circumferential horizontally oriented portion of the side wall 82 is formed above the second part 144 of the side wall 82.

Alternatively, a circumferential ledge or a plurality of ledges may be formed just above the lugs as a final retention for the disk 120.

Another solution contemplated would be to dramatically increase the size of the disk 120.

Figure 19:
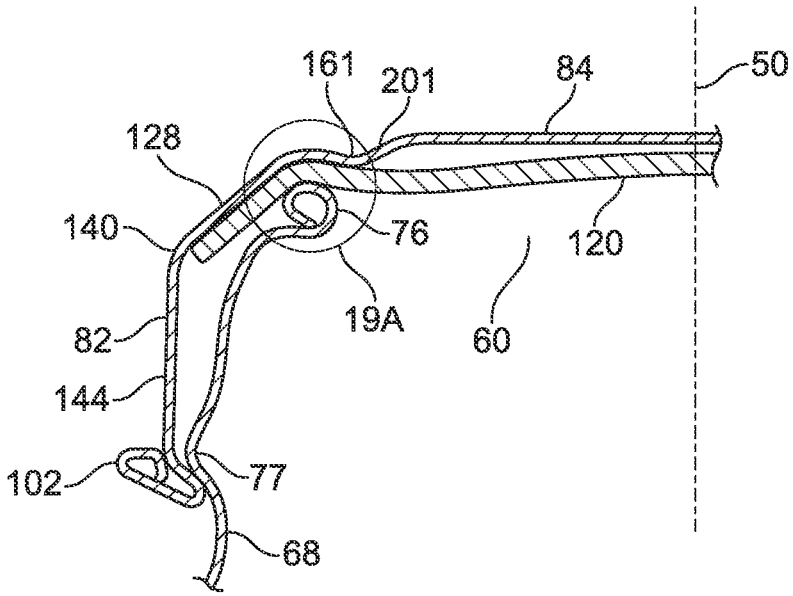
FIG. 19 is a partial cross-sectional view of an embodiment of the present invention.
Figure 19A:
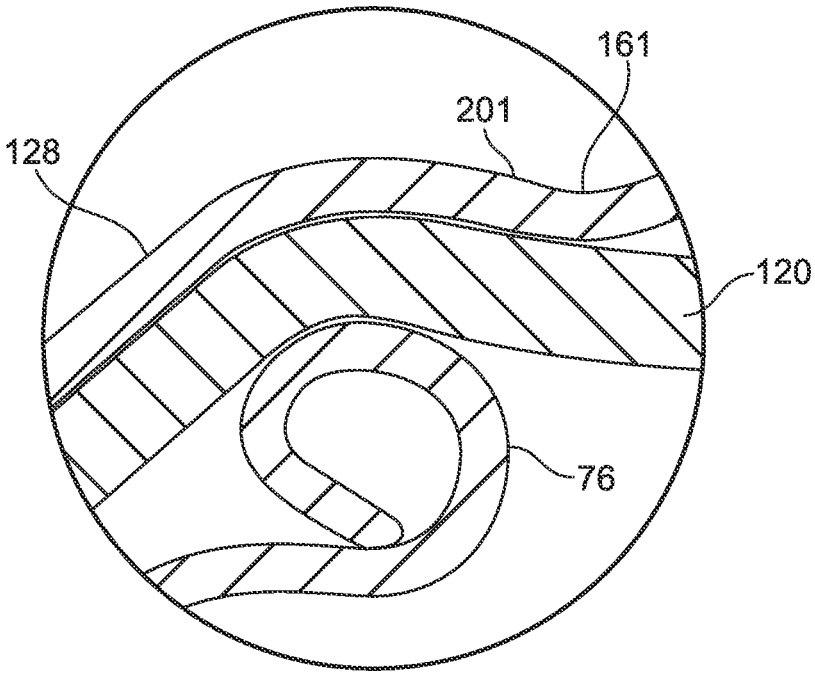
FIG. 19A is a magnified view of a portion of FIG. 19.

Another solution is illustrated in FIG. 19. Here, the top bead 201 on the top panel 84 of the cap 80 is formed inside of the flange 76 curl defining the opening 60. By increasing the stress on a radially inner portion of the disk 120, it is believed that distortion of a radially outer peripheral edge of the disk 120 is reduced. In this embodiment, a clearance gap 204 between the disk 120 and the outermost peripheral edge of the top panel 84, located between the curl of the flange 76 and the top panel 84, is eliminated by increasing the depth of the top bead 201. As illustrated in the commercially available embodiment shown in FIG. 10, a gap 204 in this area generally occurs. The inventors eliminated this gap 204 by decreasing a depth of the top bead 201 to a distance less than 0.040 inches (0.102 cm). Stated another way, a depth of the peripheral edge of the top panel 84 above the curl of the flange 84 is preferably about 30% less than a depth of the top bead 201 as measure from an imaginary horizontal plane defined by a radially inward adjacent portion of the top panel 84. Thus, a differential height between the peripheral edge of the top panel 84 and the lowermost point of the top bead 201 is about 0.011 inches (0.028 cm).

Figure 20:
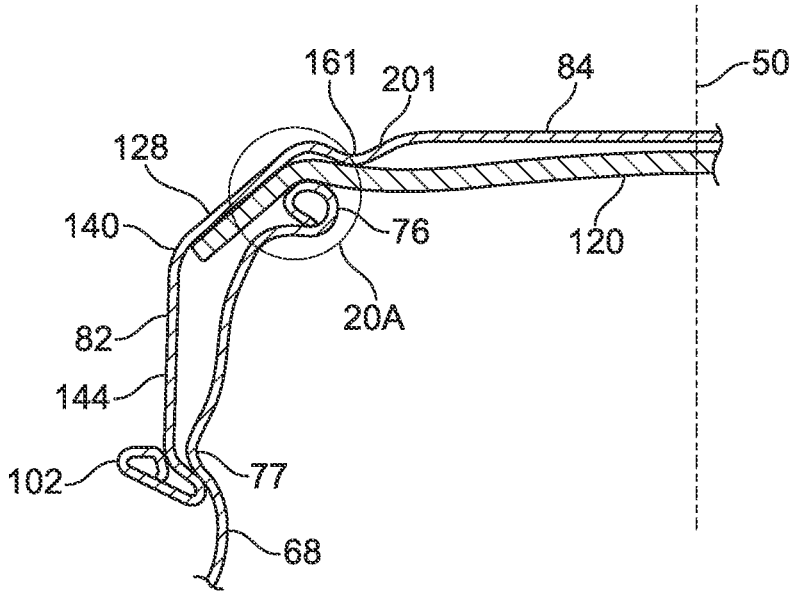
FIG. 20 is a partial cross-sectional view of an embodiment of the present invention.
Figure 20A:
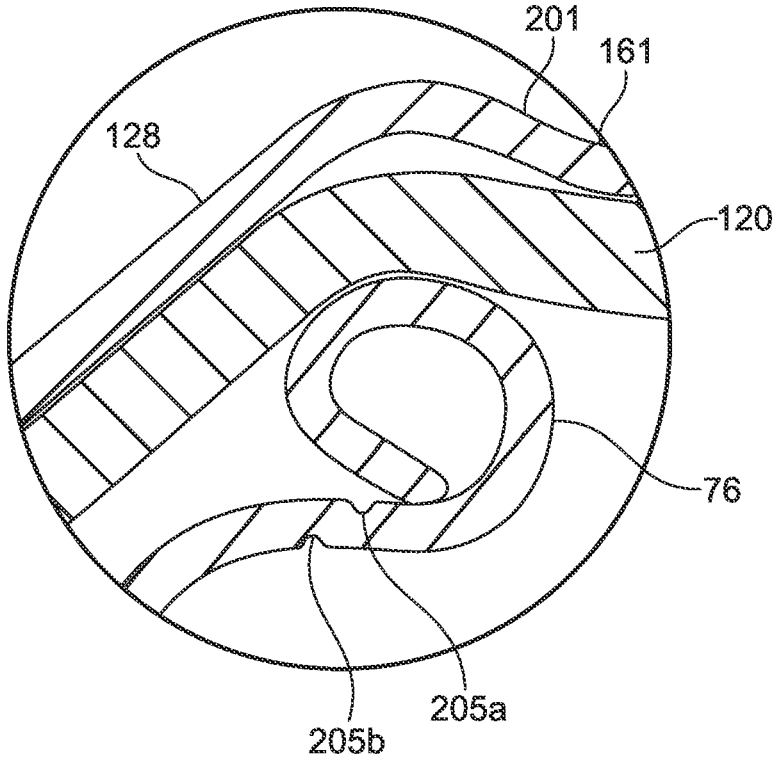
FIG. 20A is a magnified view of a portion of FIG. 20.

Another solution is illustrated in FIG. 20. In this embodiment, a flexible hinge is located on the flange 75 just below the curl defining the opening 60. The flexible hinge may be created by a pair of narrow circumferential channels 205*a,b* formed in the flange just below curl. The channels preferably have a U-shaped cross-section having a radius of curvature of about 0.003 inches (0.008 cm). One channel 205*a* may be located radially inwardly of the second channel 205*b*. Similarly, one channel 205*a* may be located on the public side of the flange 76 while the other channel 205*b* is located on the product side of the flange 76. Preferably, the radially inner channel 205*a* is located on the public side of the flange 76, and the radially outer channel 205*b* is located on the product side of the flange 76.

Figure 21A:
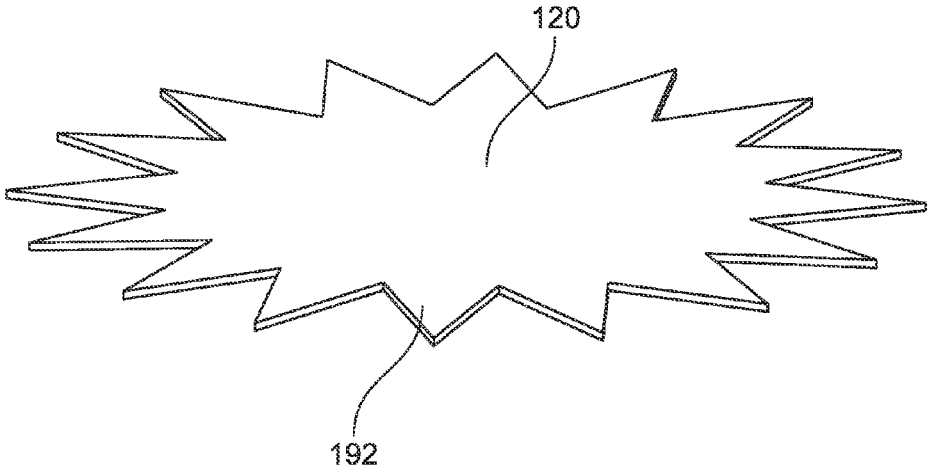
FIG. 21A is a perspective view of a liner disk for use in any of the embodiments described herein.
Figure 21B:
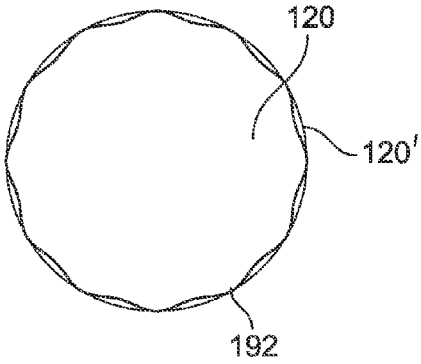
FIG. 21B is a top view of an alternative embodiment of the liner of FIG. 21A also showing the outline of a conventional prior art liner.
Figure 21C:
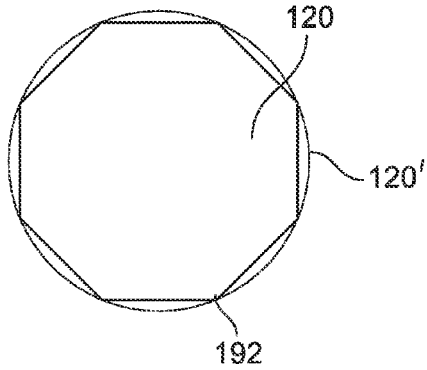
FIG. 21C is a top view of an alternative embodiment of the liner of FIG. 21A also showing the outline of a conventional prior art liner.
Figure 21D:
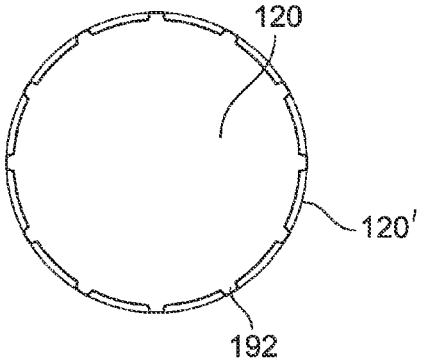
FIG. 21D is a top view of an alternative embodiment of the liner of FIG. 21A also showing the outline of a conventional prior art liner.
Figure 21E:
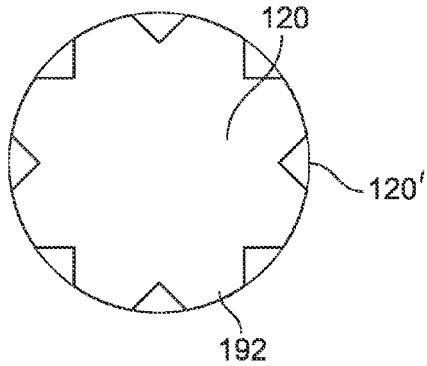
FIG. 21E is a top view of an alternative embodiment of the liner of FIG. 21A also showing the outline of a conventional prior art liner.

Another solution is illustrated in FIGS. 21A through 21E. In these embodiments, the disk 120 has a plurality of extensions 192 radiating outwardly from a peripheral edge of the disk 120. Each extension may terminate at a radially outermost point at a sharp or pointed corner giving the disk 120 a starburst shape wherein each extension 192 has a generally triangular shape. Alternatively, the extension may terminate at rounded outermost ends and have a smooth wave circumferential shape as shown in FIG. 21B, an polygonal shape, preferably an octagon shape as shown in FIG. 21C, a spoked shape as shown in FIG. 21D, or have truncated extensions 192 of the starburst shaped version as illustrated in FIG. 21E. The shape of a conventional disk is shown as 120' to illustrate the departure in shape and size from a conventional disk. These disks, like any of the other embodiments, including the disks illustrated in FIGS. 22-25, to the extent they do not conflict, can be used in any combination with other embodiments disclosed herein.

Figure 22:
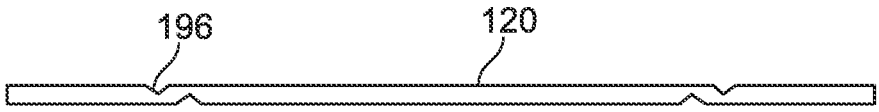
FIG. 22 is a cross-sectional view of a liner disk for use with any of the embodiments described herein.
Figure 23:
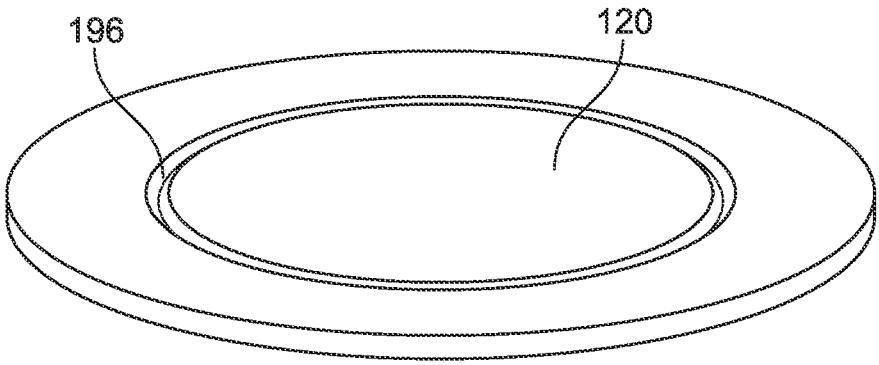
FIG. 23 is a perspective view of the liner disk of FIG. 22.

Another solution is illustrated in FIGS. 22-23. Here, one or more circumferential relief grooves 196 are formed or cut into the disk 120 at the area where the disk 120 bends about the flange 76. In the example illustrated, a first groove 196 is formed on a product side of the disk 120, and a second groove 196 is formed on an opposing side of the disk 120. The relief grooves 196 allow the disk 120 to spring back "flat" after pasteurization.

Figure 24:
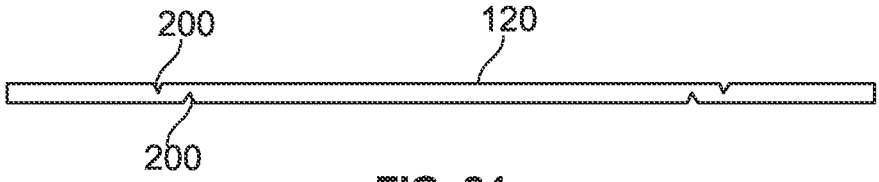
FIG. 24 is a cross-sectional view of a liner disk for use with any of the embodiments described herein.
Figure 25:
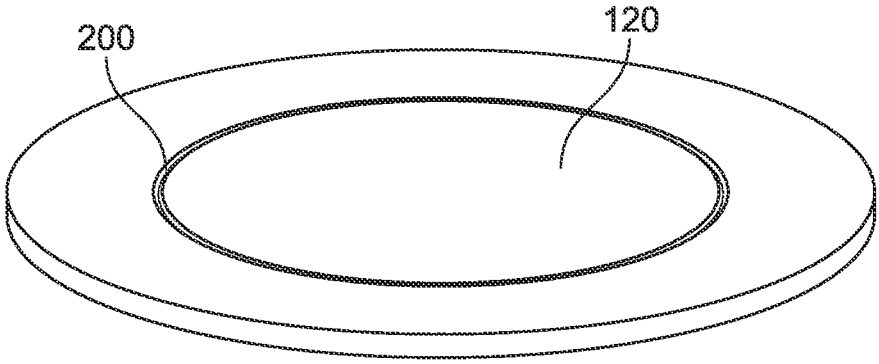
FIG. 25 is a perspective view of the liner disk of FIG. 25.

Another solution is illustrated in FIGS. 24-25. Here, one or more circumferential scores 200 are or cut into the disk 120 at the area where the disk 120 bends about the flange 76. In the example illustrated, a first score 200 is formed on a product side of the disk 120, and a second score 200 is formed on an opposing side of the disk 120. The scores 200 allow the disk 120 to spring back "flat" after pasteurization.

Additionally, the variation of the ovality of the disks 120 may be improved by decreasing the ovality of the disks 120, and/or the disks 120 can be attached to the cap 80 with an adhesive such as hot glue or the like.

Figure 26:
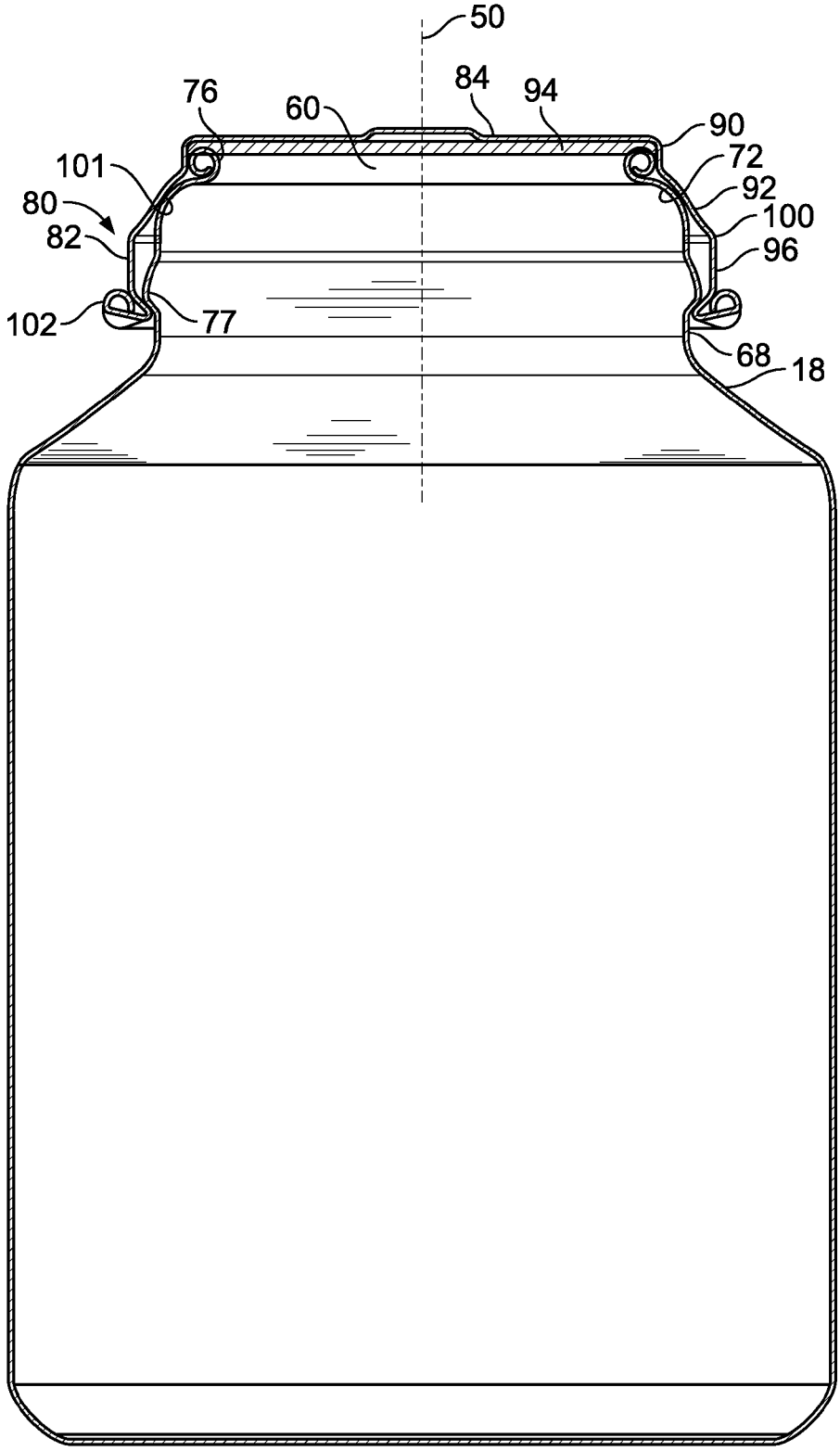
FIG. 26 is a cross-sectional of a container wherein an end portion including the opening is integral with a container side wall.

Alternatively, as shown in FIG. 26, a can body of the present invention may include an integral end portion wherein seaming is unnecessary.

One of ordinary skill in the art would appreciate that the terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "attached," "joined," and/or "connected" as used herein are intended to put or bring two elements together so as to form a unit, and any number of elements, devices, fasteners, etc. may be provided between the joined or connected elements unless otherwise specified by the use of the term "directly" and/or supported by the drawings. Finally, the term "concave," when used to modify the term "bend," is intended to describe a formation as relative to a radially outer (or public) surface; the term "convex," when used in the same manner is also intended to describe a formation relative to the radially outer surface.

While the specific embodiments have been illustrated and described, numerous modifications come to mind without significantly departing from the spirit of the invention, and the scope of protection is only limited by the scope of the accompanying Claims.

The invention claimed is:

1. A cap for sealing a container having a closure assembly comprising lug members on the container for sealing with corresponding lugs on the cap, the cap comprising:

a top panel positioned about a longitudinal axis and extending radially outwardly therefrom; and a circumferential side wall panel integral with an outer peripheral edge of the top panel comprising a first part extending downwardly and radially outwardly at an angle less than 90 degrees and a second part extending downwardly and substantially vertically from the first part wherein a radially inwardly concave bead is formed in the first part.

2. The cap of claim 1 wherein the concave bead is located at a distance greater than 1.78 cm from the longitudinal axis.

3. The cap of claim 1 wherein the concave bead is located at a distance between 1.78 cm and 1.85 cm from the longitudinal axis.

4. The cap of claim 1 wherein the concave bead has a radius of curvature less than 0.091 cm.

5. The cap of claim 1 wherein the concave bead has a radius of curvature between 0.015 cm and 0.091 cm.

6. The cap of claim 1 wherein the concave bead is bounded on opposing ends by a pair of radially outwardly convex bends having radii of curvature less than 0.223 cm.

7. The cap of claim 1 wherein the concave bead has a bead depth as measured from a public side of a lowermost point of a peripheral edge of the top panel less than or equal to 0.127 cm.

8. The cap of claim 1 wherein the concave bead has a bead depth as measured from a public side of a lowermost point of a peripheral edge of the top panel between 0.051 cm and 0.102 cm.

9. The cap of claim 1 further comprising a disk of a polymeric material in communication with a product side of the cap.

10. The cap of claim 1 wherein the concave bead is circumferential.

11. The cap of claim 1 wherein the cap comprises a plurality of concave beads about a circumference of the cap.

12. The cap of claim 1 further comprising a disk of a polymeric material having an outer peripheral edge in communication with a product side of the concave bead.

13. A cap for sealing a container having a closure assembly comprising lug members on the container for sealing with corresponding lugs on the cap, the cap comprising:

a top panel positioned about a longitudinal axis and extending radially outwardly therefrom; and a sidewall extending downwardly from the top panel comprising:

a first part extending downwardly and radially outwardly at an angle greater than 90° to the top panel; and a second part located below the first part and extending substantially vertically therefrom, wherein the first part comprises a bead extending radially inwardly and located between two convex bends wherein a first outwardly convex bend joins the first part with the top panel and a second outwardly convex bend joins the first part with the second part.

14. The cap of claim 13 wherein the bead is circumferential.

15. The cap of claim 14 wherein the second part terminates at a radially outwardly extending curl.

16. The cap of claim 15 wherein the bead separates the first part into three segments, a first segment is directly joined to the top panel and extends downwardly and radially outwardly from the outer peripheral edge of the top panel, a second segment comprises a radially inwardly concave segment and extends downwardly and further outwardly from the first segment, and a third segment extends downwardly and radially outwardly from a lowermost portion of the second segment.

17. The cap of claim 16 wherein a lowermost portion of the third segment is joined to the second part of the side wall.

18. The cap of claim 15 wherein the bead has a radius of curvature between 0.006 inches to 0.072 inches.

19. The cap of claim 18 wherein the inwardly concave segment of the second segment of the first part of the sidewall separates a pair of outwardly convex bends defining an opening of the inwardly concave segment and wherein each outwardly convex bend has a radius of curvature between 0.050 inches to 0.090 inches.

20. The cap of claim 13 further comprising:

a disk within the sidewall and extending radially outwardly from the longitudinal axis, wherein the bead has a bead radius measured from the longitudinal axis less than a distance of an edge of the disk to the longitudinal axis.

21. The cap of claim 13 wherein the bead has a bead radius measured from the longitudinal axis and a bead depth adapted to produce an on-torque between 22 in*lb and 34 in*lb and a leak pressure between 102 psig and 119 psig.

* * * * *